US009450354B2

(12) United States Patent
Little et al.

(10) Patent No.: US 9,450,354 B2
(45) Date of Patent: Sep. 20, 2016

(54) DUAL ORIENTATION CONNECTOR AND ASSEMBLY OF THE SAME

(71) Applicant: HON HAI PRECISION INDUSTRY CO., LTD., New Taipei (TW)

(72) Inventors: Terrance F. Little, Fullerton, CA (US); Chih-Pi Cheng, New Taipei (TW); Stephen Sedio, Valley Center, CA (US); Chien-Ping Kao, Hummels town, PA (US); Ming-Lun Szu, New Taipei (TW); Chun-Yi Chang, New Taipei (TW); Wei-Hung Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 89 days.

(21) Appl. No.: 14/273,559

(22) Filed: May 9, 2014

(65) Prior Publication Data

US 2014/0335729 A1 Nov. 13, 2014

Related U.S. Application Data

(60) Provisional application No. 61/821,257, filed on May 9, 2013, provisional application No. 61/832,756, filed on Jun. 7, 2013.

(51) Int. Cl.

| | |
|---|---|
| ***H01R 9/03*** | (2006.01) |
| ***H01R 24/60*** | (2011.01) |
| *H01R 12/72* | (2011.01) |
| *H01R 13/64* | (2006.01) |
| *H01R 13/6594* | (2011.01) |

(52) U.S. Cl.

CPC ..... *H01R 24/60* (2013.01); *H01R 12/724* (2013.01); *H01R 13/64* (2013.01); *H01R 13/6594* (2013.01)

(58) Field of Classification Search

CPC ..... H01R 23/6873; H01R 23/7073
USPC ..... 439/607.53, 607.4, 660
See application file for complete search history.

(56) References Cited

U.S. PATENT DOCUMENTS

| | | | | |
|---|---|---|---|---|
| 6,358,089 | B1 * | 3/2002 | Kuroda | H01R 12/716 439/607.13 |
| 7,094,089 | B2 * | 8/2006 | Andre | H01R 12/7088 439/218 |
| 7,364,464 | B2 * | 4/2008 | Iino | H01R 12/716 439/607.55 |
| 7,524,213 | B2 * | 4/2009 | Neer | H01R 13/65802 439/680 |
| 8,882,524 | B2 * | 11/2014 | Golko | H01R 13/6273 439/218 |
| 8,911,260 | B2 * | 12/2014 | Golko | H01R 13/6581 439/108 |
| 8,961,235 | B2 * | 2/2015 | Little | H01R 13/64 439/374 |
| 2005/0202727 | A1 * | 9/2005 | Andre | H01R 12/7088 439/660 |
| 2013/0089291 | A1 * | 4/2013 | Jol | H01R 13/405 385/77 |

(Continued)

*Primary Examiner* — Hae Moon Hyeon
(74) *Attorney, Agent, or Firm* — Wei Te Chung; Ming Chieh Chang

(57) ABSTRACT

An electrical connector includes an insulative housing with a base and a mating tongue extending forwardly in a front-to-rear direction from the base, the mating tongue defining a first surface and a second surface opposite to each other. A plurality of contact strips is disposed around the outer surface of the mating tongue of the insulative housing, each contact strip is stamped from a metal sheet and defines a first contacting section exposed upon the first surface and arranged along a transverse direction perpendicular to the front-to-rear direction, and a second contacting section exposed upon the second surface and arranged along the transverse direction.

14 Claims, 32 Drawing Sheets

(56) References Cited

U.S. PATENT DOCUMENTS

2013/0095701 A1* 4/2013 Golko ..... H01R 13/6581
439/660

2013/0095702 A1* 4/2013 Golko ..... H01R 13/6273
439/676

2015/0155657 A1* 6/2015 Golko ..... H01R 13/516
439/345

* cited by examiner

| PIN No | Assignment |
|---|---|
| 1 | PD/I Detect |
| 2 | Vbus |
| 3 | USB2 D+ |
| 4 | USB2 D- |
| 5 | GND |
| 6 | USB3 RX |
| 7 | GND |
| 8 | USB3 TX |
| 9 | GND |
| 10 | USB3 TX |
| 11 | GND |
| 12 | USB3 RX |
| 13 | GND |
| 14 | USB2 D+ |
| 15 | USB2 D- |
| 16 | Vbus |
| 17 | PD/I Detect |

| PIN No | Assignment |
|---|---|
| 1 | PD/I Detect |
| 2 | Vbus |
| 3 | USB2 D+ |
| 4 | USB2 D- |
| 5 | GND |
| 6 | USB3 RX |
| 7 | GND |
| 8 | USB3 TX |
| 9 | GND |
| 10 | USB3 TX |
| 11 | GND |
| 12 | USB3 RX |
| 13 | GND |
| 14 | USB2 D+ |
| 15 | USB2 D- |
| 16 | Vbus |

FIG. 27

DUAL ORIENTATION CONNECTOR AND ASSEMBLY OF THE SAME

The instant application claims benefit of the application No. 61/821,257 filed May 9, 2013 and application No. 61/832,756 filed Jun. 7, 2013.

BACKGROUND OF THE INVENTION

1. Field of the Invention

The present invention relates generally to input/output electrical connectors such as data connectors, especially to USB 2.0 or USB 3.0 connector.

2. Description of Related Art

Many standard data connectors such as Universal Serial Bus (USB) connectors are also only available in sizes that are limiting factors in making portable electronic devices smaller, which will not meet the lower profile request in electronic device. Many standard data connectors require that they be mated with a corresponding connector in a single, specific orientation. Such connectors can be referred to as polarized connectors. It is sometimes difficult for the user to determine when a polarized connector.

SUMMARY OF THE INVENTION

Accordingly, an object of the present invention is to provide an electrical connector including an insulative housing with a base and a mating tongue extending forwardly in a front-to-rear direction from the base, the mating tongue defining a first surface and a second surface opposite to each other. A plurality of contact strips are disposed around the outer surface of the mating tongue of the insulative housing, each contact strip is stamped from a metal sheet and defines a first contacting section exposed upon the first surface and arranged along a transverse direction perpendicular to the front-to-rear direction, and a second contacting section exposed upon the second surface and arranged along the transverse direction. The first and second contacting sections of each contact strip extend along the front-to-rear direction and rearwardly extending into the base of the insulative housing.

Other objects, advantages and novel features of the invention will become more apparent from the following detailed description when taken in conjunction with the accompanying drawings.

BRIEF DESCRIPTION OF THE DRAWINGS

FIG. 27 is a diagram to show the pin assignment of the connector assembly of FIG. 26.

DETAILED DESCRIPTION OF THE PREFERRED EMBODIMENT

Reference will now be made in detail to the preferred embodiment of the present invention.

Figure 1:
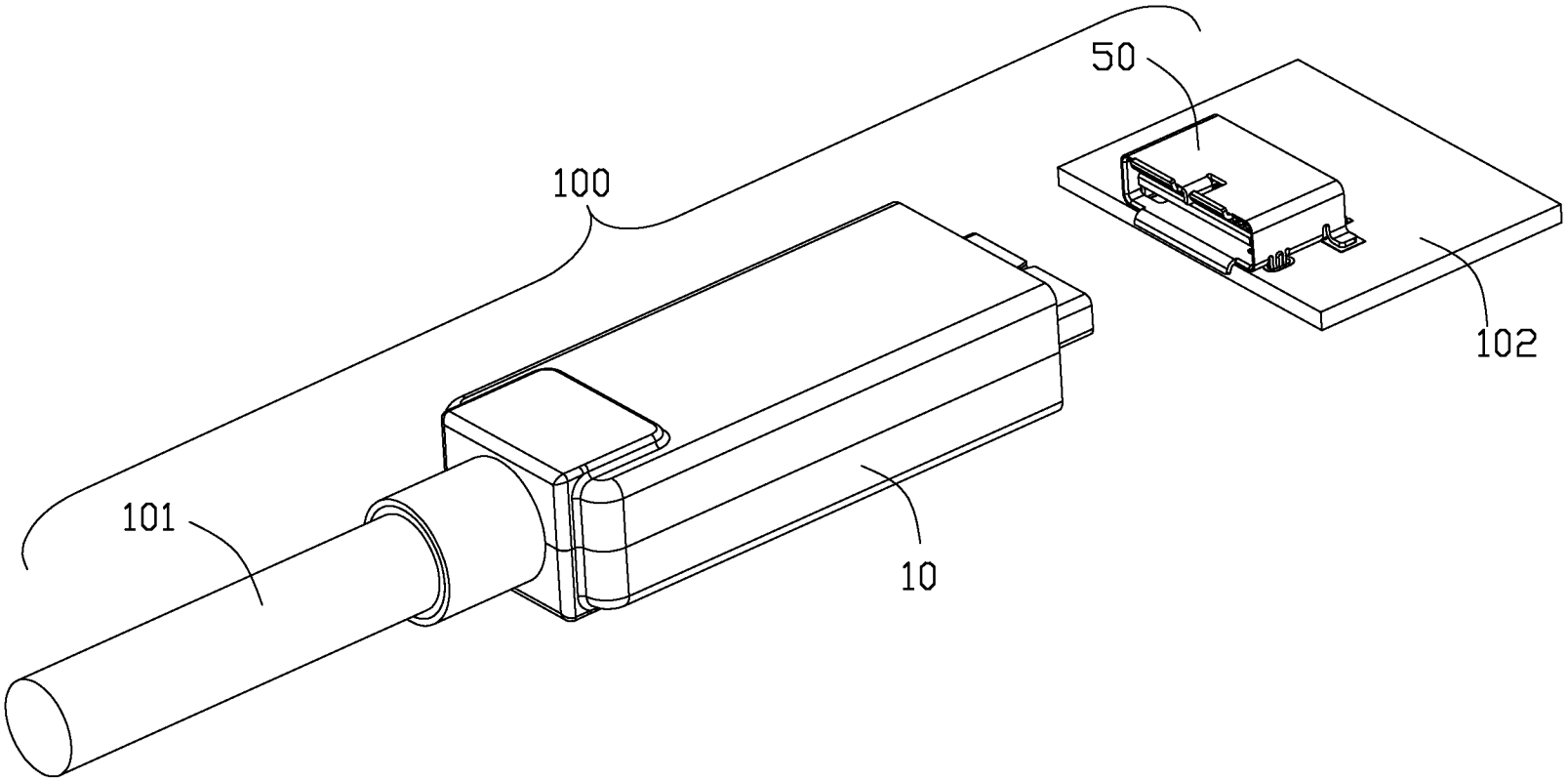
FIG. 1 is a perspective view showing an electrical connector assembly having a plug and a receptacle of a first embodiment in accordance with the present invention.
Figure 2:
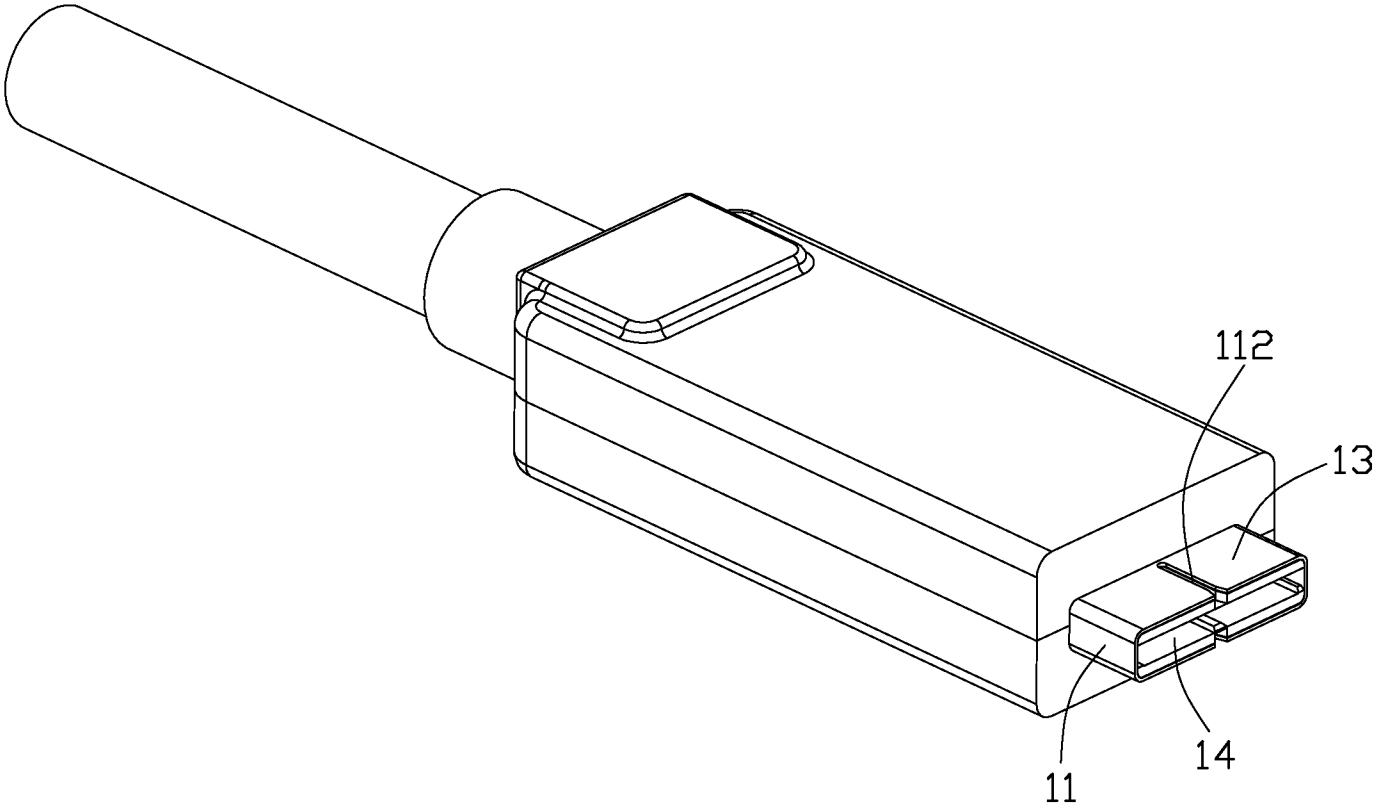
FIG. 2 is a perspective view showing the plug of FIG. 1.
Figure 3:
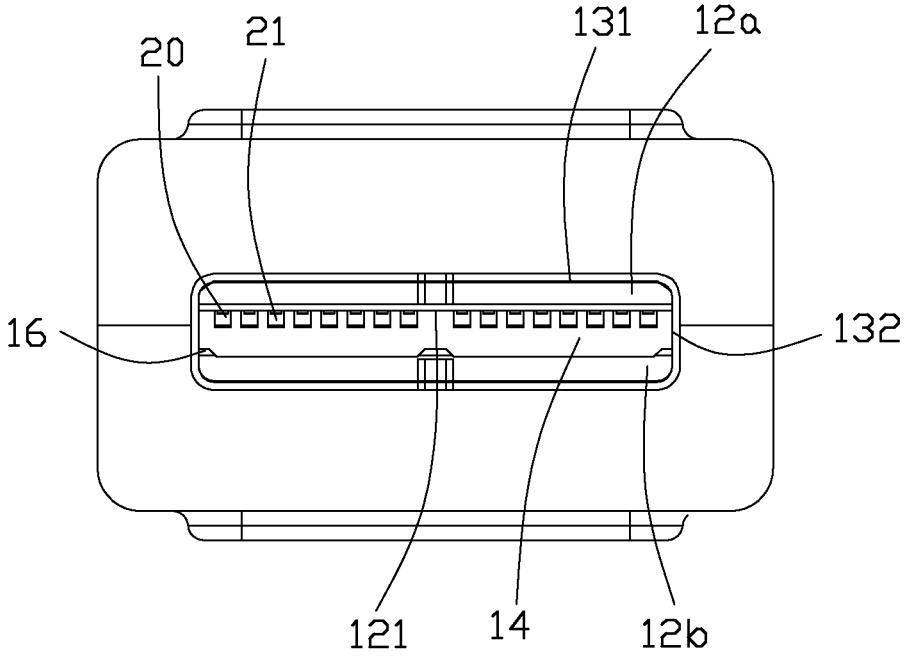
FIG. 3 is a front elevational view showing the plug of FIG. 1.
Figure 8:
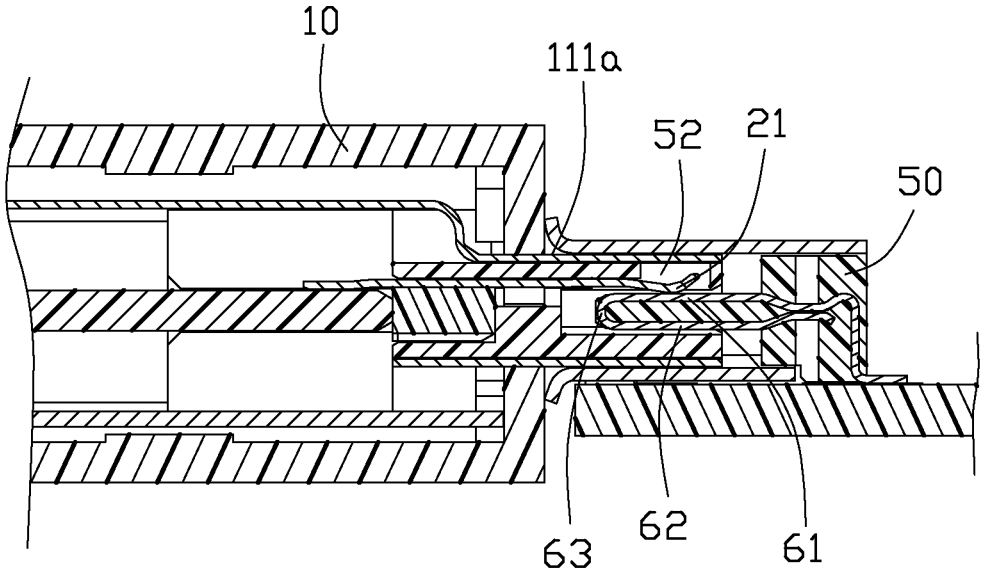
FIG. 8 is a cross-section view showing an engagement of the receptacle and the plug in an up position of insertion of the plug of FIG. 1.
Figure 9:
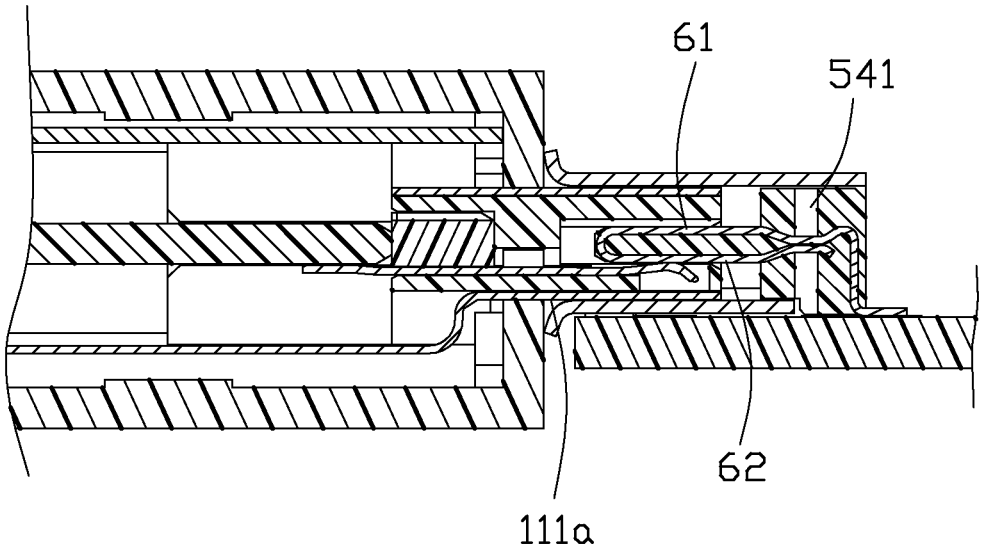
FIG. 9 is a cross-sectional view showing an engagement of the receptacle and the plug in a down position of insertion of the plug of FIG. 1.

Referring to FIGS. 1-3, an electrical connector assembly 100 includes a plug connector 10 connecting with a cable 101 and a receptacle connector 50 mounted on a printed circuit board 102. The plug 10 includes a mating port 11 at a front portion thereof, the mating port 11 includes two insulating boards 12*a*, 12*b* spaced from each other with a gap. A rectangular metallic shell 13 snugly covers on two outer faces of the insulative boards 12*a*, 12*b* by two long walls 131 thereof, two short walls 132 of the metallic shell 13 together with the insulative boards commonly define a mating slot 14 among the short walls and the inner faces of the insulative boards 12*a*, 12*b*. A plurality of conductive contacts 20 are located in the plug 10 in one row with contacting portions 21 exposing along a first inner side 121 of a one/first insulative board 12*a* of the plug. As best shown in FIG. 8, the contacting portions 21 slant toward the mating slots 14 with elasticity. The outline of the mating port 11 of the plug have a 180 degree symmetrical, double orientation design which enables the plug 10 to be inserted into a corresponding receptacle 50 in both a first orientation where a top surface 111*a* as shown in FIG. 8 is facing up or a second orientation where the top surface 111*a* is rotated 180 degrees and facing down as shown in FIG. 9.

Referring to FIGS. 4-7, the receptacle 50 comprises an insulating seat or insulative housing 51, a plurality of contact strips 60 retained in the seat and a metallic shell 70 surrounding the insulating seat so as to define a mating cavity 52 with a mating tongue 53 extending in the mating cavity. The insulating seat 51 includes a base 54, said mating tongue 53 extends forward from the base. The mating tongue 53 defines an upper surface 531 and a lower surface 532 opposite to each other.

Figure 5:
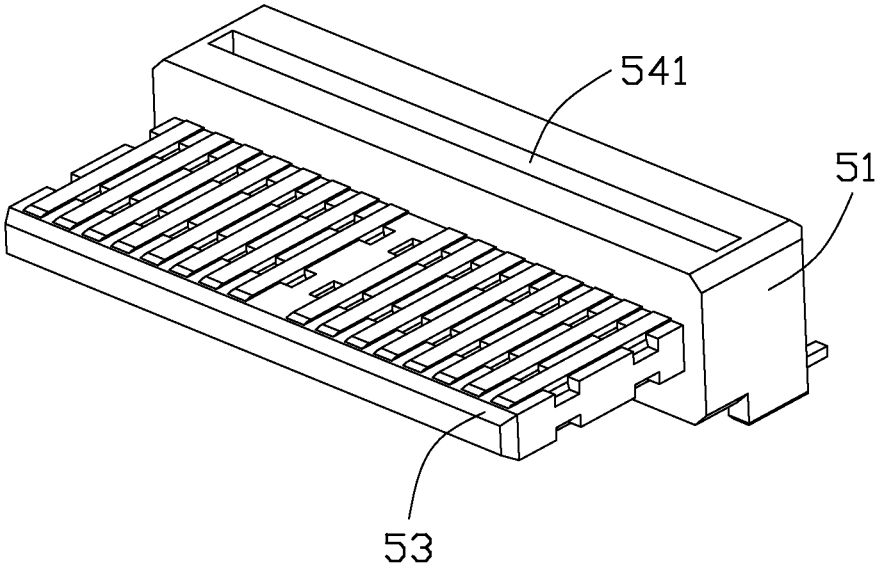
FIG. 5 is a perspective view showing an insulative seat with contact strips of the receptacle.

The contact strip 60 is stamped from a unitarily metal strip in a loop form and comprises a first contacting section 61 and a second contacting section 62 parallel to each other, said two contacting section connecting with each other by an arc connection 63. The first contacting sections 61 are embedded in the first surface of the mating tongue 53 as best shown in FIG. 5, the second contacting sections 62 are embedded in the second surface of the mating tongue 53 and the arc connection section 63 is located adjacent to a front surface of the mating tongue as best shown in FIG. 8. A mounting section 64 extending outward the base 54 of the insulating seat 51 extends downwards and a first connecting section 65 is construed between the mounting section 64 and the first contacting section 61. A second connecting section 66 extends from a rear end of the second contacting section 62 opposite to the arc section. The first and second connecting portions are arced toward each other until the two connecting sections are mechanically connected with each. It's understandably, each contacting strip 60 provides two contacting points, one at the first contacting section 61 in the first surface of the mating tongue 53 and one at the second contacting section 62 in the second surface of the mating tongue. The outline of the mating cavity 52 have a 180 degree symmetrical, double orientation design which enables the receptacle to be inserted with the plug 10 in both orientations. That means, the upper and lower half portion of the receptacle is symmetrical about a horizontal central line of the mating tongue 53.

Figure 7:
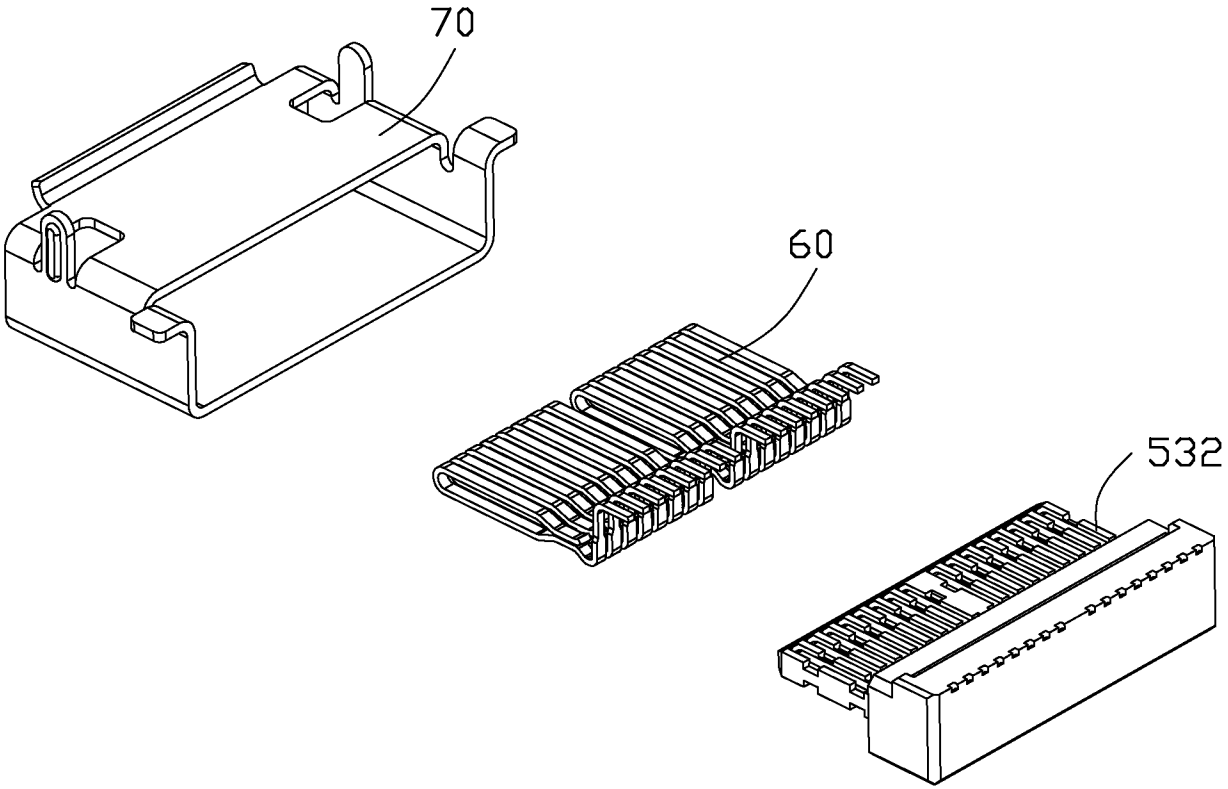
FIG. 7 is an another exploded perspective view showing the receptacle.

As shown in FIGS. 7 and 8, when the plug 10 is inserted into the mating cavity 52 of the receptacle 50 in an "up" position, i.e., the top face 111*a* facing upwards, contacting portions 21 in the plug 10 are properly aligned with the first contacting sections 61 in the receptacle connector 50, thereby the contacting portions 21 of the plug 10 mechanically and electrically connect with the first contacting sections 61 on the upper surface 531 of the mating tongue 53 of the receptacle 50. When the plug 10 is inserted into the mating cavity 52 of the receptacle in a "down" position, i.e., the top face 111*a* facing downwards, the contacting portions 21 in the plug mechanically and electrically connect with the second contacting sections 62 on the lower surface of the mating tongue 53 of the receptacle 50. Thus, whether the plug 10 is inserted into receptacle 50 in either the "up" or "down" position, proper electrical contacts are made between the contacts in the plug 10 and the receptacle 50.

Figure 10:
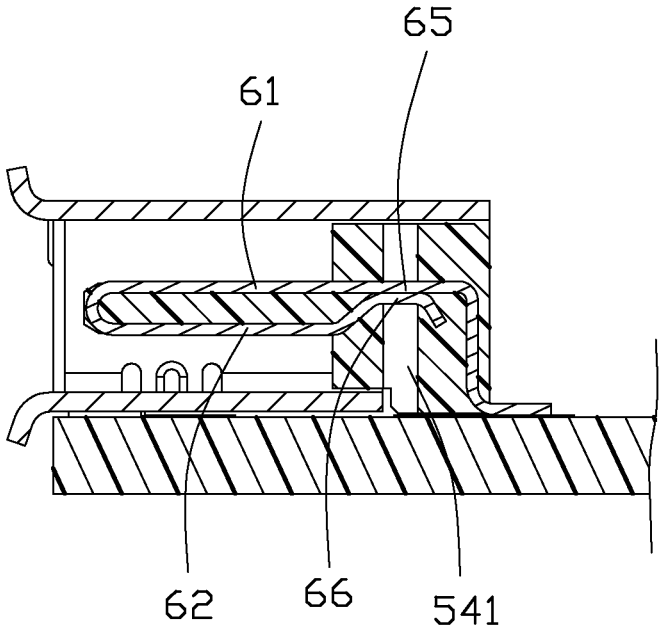
FIG. 10 is a cross-sectional view showing the receptacle of a second embodiment.

The contact strip 60 is inserted molded into the insulating seat 51. The longwise slot 541 is remained for positioning the contact strips in the base 54 by tool in FIG. 5. Seeing FIG. 8, contact strips 60 also can be positioned at the connecting sections. In alternative embodiment, a second embodiment, as shown in FIG. 10, the first connecting portions 61 and the first contacting sections 65 are located on a same level, that means, the first connecting section 65 keep linear and the second connecting sections 66 curve in a larger arc to mechanically touch with the first connecting section 65. As a mold process closes, the first connecting sections 65 close on the contact strips to assure the contact strips permanently joined together under injection pressure. The first and second connecting sections alternatively join with each other by a laser-welded way, thereby assuring a continuity therebetween.

Figure 4:
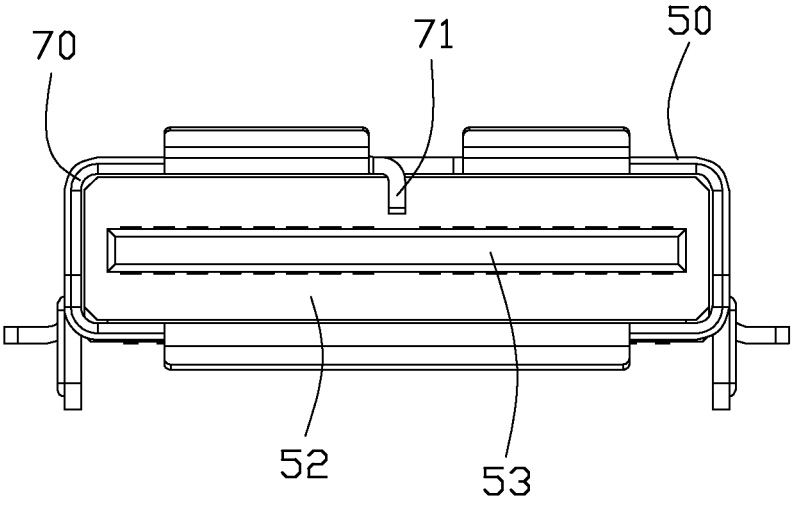
FIG. 4 is a front elevational view showing the receptacle of FIG. 1.
Figure 6:
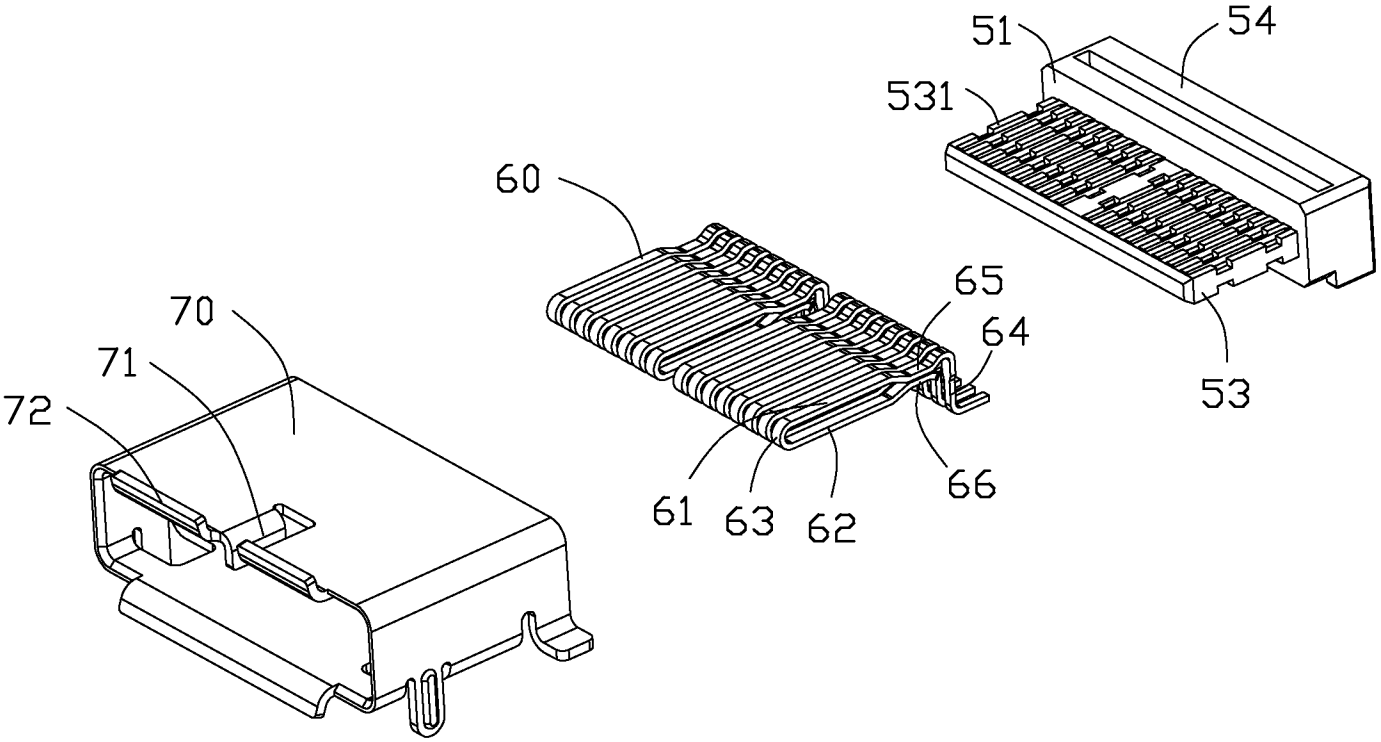
FIG. 6 is an exploded perspective view showing the receptacle.
Figure 11:
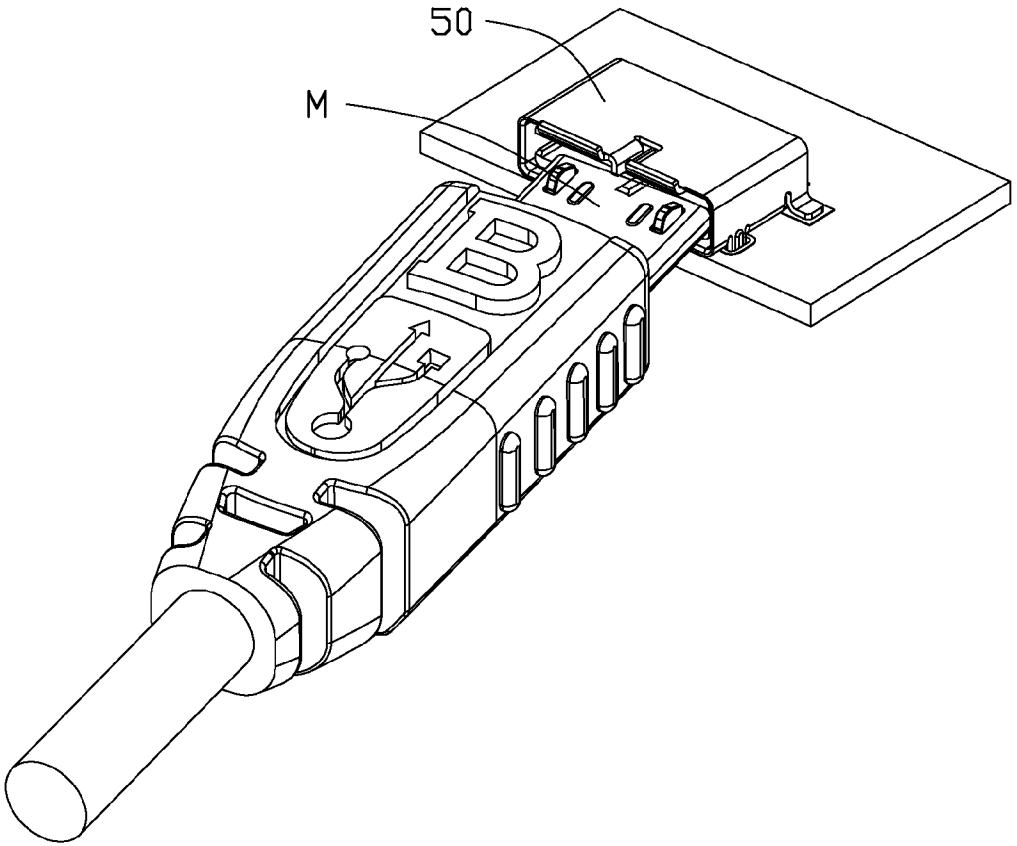
FIG. 11 is a perspective view showing an accidental insertion of a micro USB to the receptacle in the first or second embodiment.
Figure 12:
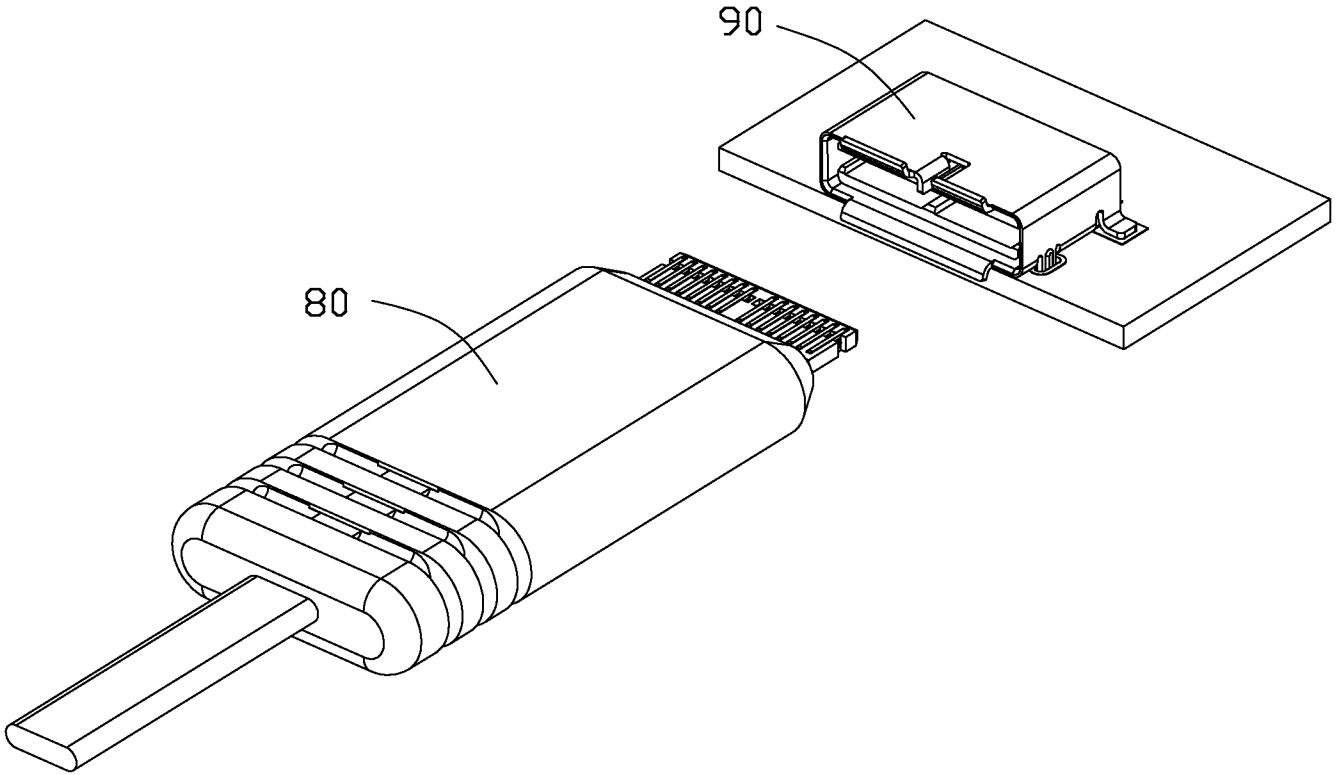
FIG. 12 is an electrical connector assembly having a plug and a receptacle of a third embodiment in accordance with the present invention.
Figure 13:
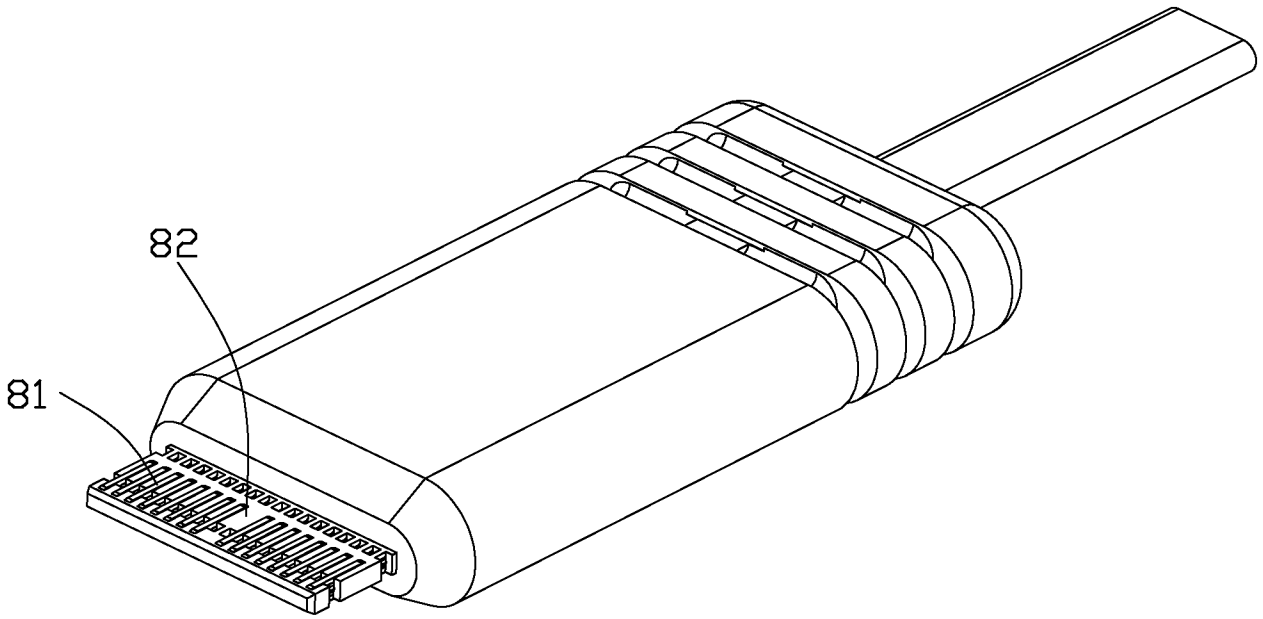
FIG. 13 is a perspective view showing the plug of FIG. 12.
Figure 14:
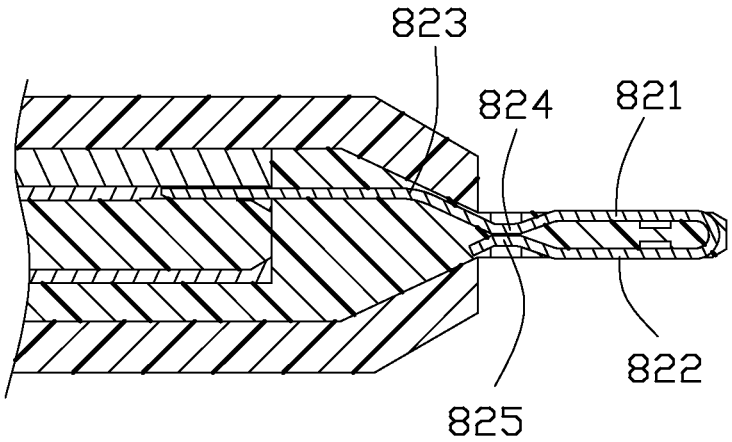
FIG. 14 is a schematic view showing the plug of FIG. 12.

The assembly of the present invention is intend to develop a concept for a high speed IO connector, which is different from standard USB connector but transmit persuade to USB transport protocol. Because many different Input/Output (I/O) connectors exist today, there is always risk of accidental insertion of one type of plug into another type of receptacle that is not the intended recipient. As shown in FIGS. 4 and 6, the mis-insertion feature is split from the metallic shell 70 of the receptacle 50 in a form of a tab 71 along an insertion direction of the assembly. The tab 71 is a rigid tab that is bent into the mating cavity 52 and extending in a plane perpendicular to the mating tongue 53. Two guiding flanges 72 curve outwards from a front edge of the shell 70 beside the tab. The tab 71 is in a middle line of the mating cavity 52 in the lateral direction. Referring to FIGS. 2 and 3, the mating port 11 of the plug 10 defines two slots 112, the slots run through the outer surfaces of the mating port 11 along the insertion direction. The slots 112 of the corresponding plug 10 will guide the tab 71 of the receptacle 50 into one of said two slots of the plug 10, while this tab 71 will not allow a Micro USB plug M in an illustrated case to be inserted the receptacle, even during slant mating as shown in FIG. 11 or when shifted to one side. By adding the mis-insert features within the shell of the receptacle, this will greatly reduce the risk of the mating tongue 52 breakage. The mating slot 14 defined three ribs 16 at another inner side of the insulative board 12*b* to help balance the normal forces of the contacts 20 since there is only one row of contacts.

Referring to FIGS. 12 to 15 illustrating an alternative embodiment, a third embodiment, an electrical connector assembly includes a plug 80 connecting with a cable and a receptacle 90 mounted on a printed circuit board. The plug 80 defines a front mating tongue 81 made from material and a plurality of conducive contact strip 82 embedded in the mating tongue 80. Each contact strip 82 include a first contacting section 821 and a second section 822 located on opposite surface of the mating tongue 80. A cable mounting section 823 connects with the cable, the first and second connecting sections 824, 825 mechanically and electrically by laser-welded. The mating tongue and the first and the second contacting sections have a 180 degree symmetrical, double orientation design.

Figure 15:
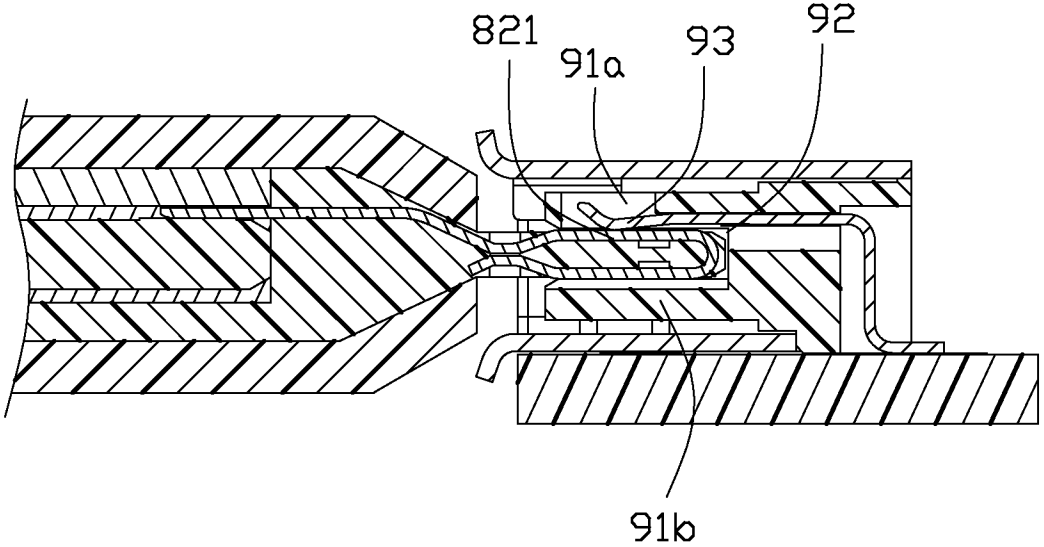
FIG. 15 is a cross-sectional view showing an engagement of the receptacle and the plug in an up position of insertion of the plug of FIG. 12.
Figure 16:
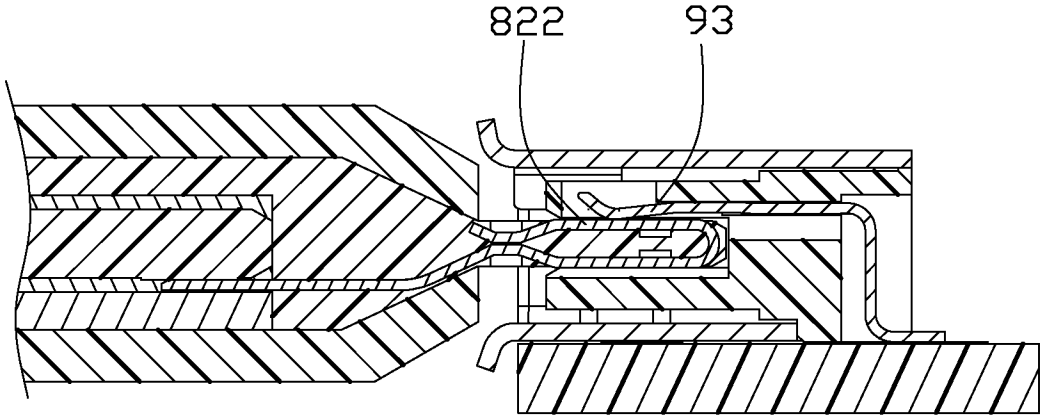
FIG. 16 is a cross-sectional view showing an engagement of the receptacle and the plug in a down position of insertion of the plug of FIG. 12.

The receptacle 90 defines a mating cavity 92 between two insulative board 91*a*, 91*b*, a plurality of conductive contacts 93 are located at one inner side of the mating cavity 93. As shown in FIGS. 15-16, whether the plug 80 is inserted into receptacle 90 in either the "up" or "down" position, i.e., in a flippable manner, proper electrical contacts are made between the contacts and contact strip in the plug 80 and the receptacle 90.

Figure 17:
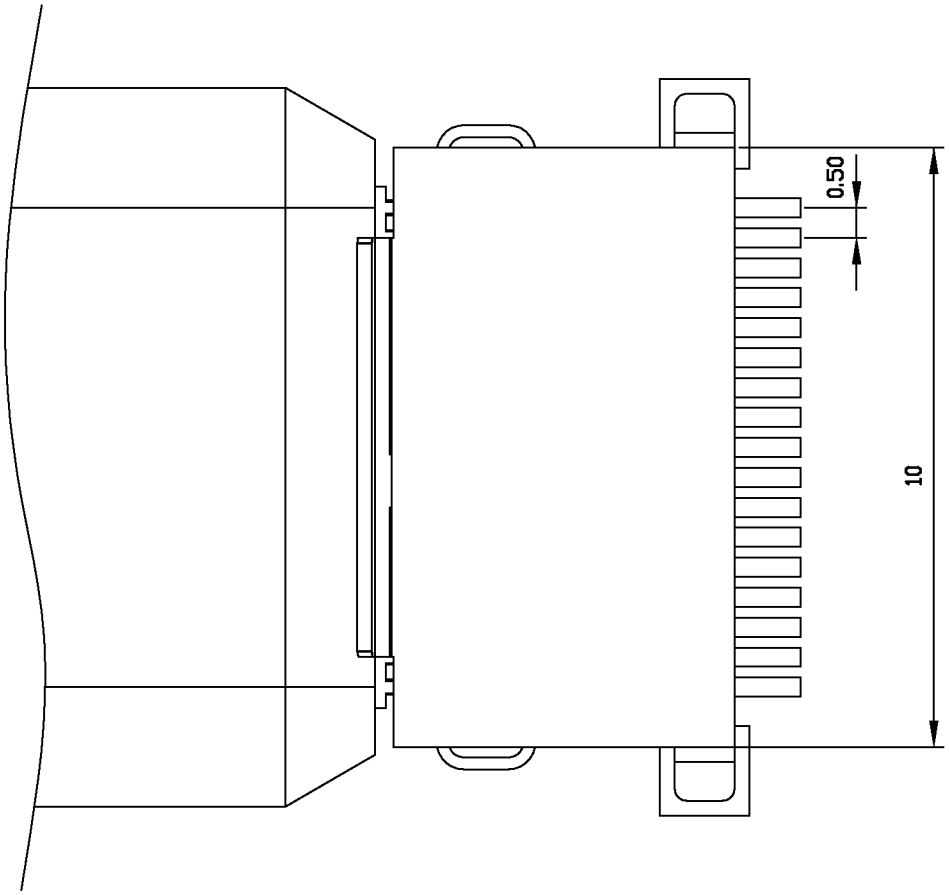
FIG. 17 is a schematic view showing the pin assignment of the connector assembly.

Notably, as shown in FIG. 17, each differential pair (USB RX), (USB TX), (USB2 D+), or (USB2 D−) are located at two sides of a centre contact pin in a symmetrical manner, such as a grounding pin P9 so that each contact strip 60 can provide two contacting points with only one mounting section connecting with a corresponding circuits on the printed circuit board (PCB). Notably, the center contact pin is not shown in either the receptacle or the plug in the corresponding figures; anyhow, the remaining sixteen contacts are still symmetrically arranged by two sides of such imaginary center/ground contact, i.e., the center line, to allow the plug to be inserted into the receptacle in a flippable manner, i.e., the dual orientations.

Figure 18:
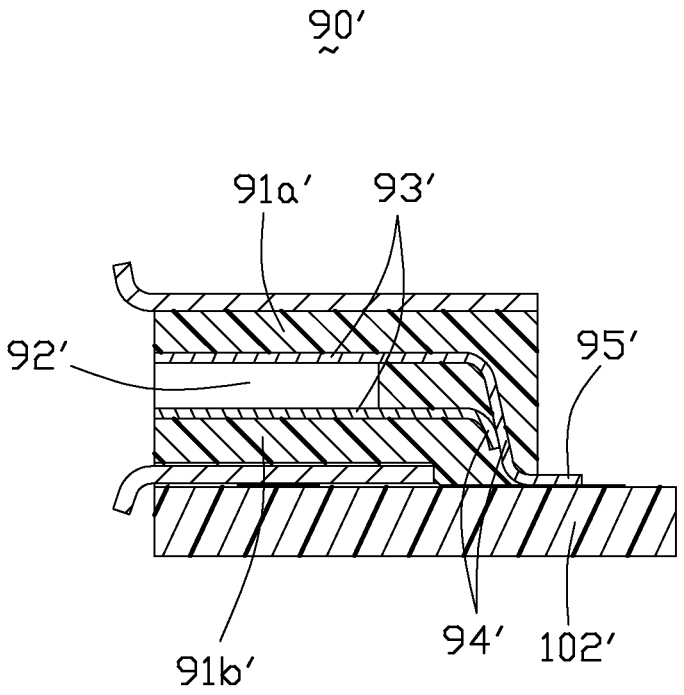
FIG. 18 is a cross-sectional view of the receptacle connector in a fourth embodiment.

FIG. 18 shows another embodiment, a fourth embodiment, of the receptacle 90' which, similar to the receptacle 90', includes an insulative housing defining a mating cavity 92' between two opposite insulative board 91*a*' and 91*b*'. The difference relative to the receptacle 90' is that there are pairs of contact 93' respectively located upon the opposite surfaces of the insulative boards 91*a*' and 91*b*' facing to the mating cavity 92' wherein connecting sections 94' of the each pair of contacts 93' are joined or connected with each other with only one mounting section 95' mounted to the printed circuit board 102'. Understandably, if adequate, each pair of contacts 93' can be made of one piece via blanking from sheet metal, like the traditional SIMM contact. Understandably, in this embodiment the mating plug only requires to have the resilient corresponding contact on only one surface similar to the first embodiment of FIG. 8 while still achieving flappable effect. Furthermore, in an alternate embodiment relative to FIG. 18, the receptacle can be equipped with the resilient contact as disclosed in the embodiment of FIGS. 15 and 16 while the plug can be equipped with the stationary as disclosed in the embodiment of FIGS. 15 and 16.

Figure 19:
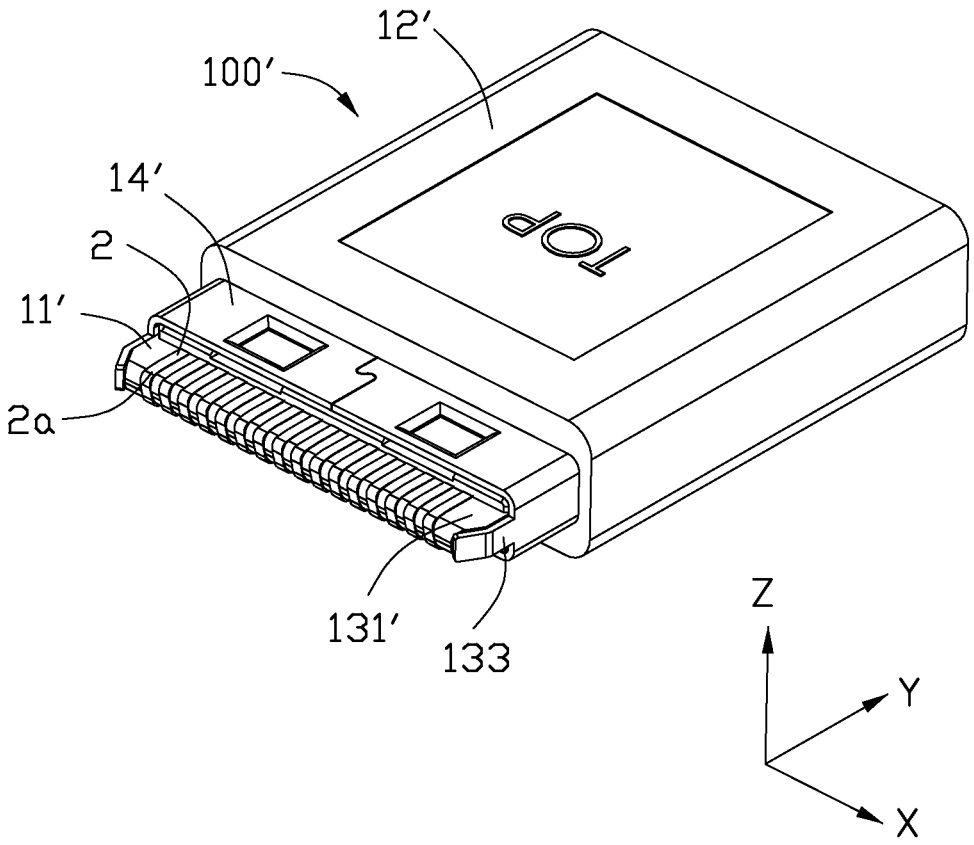
FIG. 19 is a front top perspective view of a plug connector in accordance with a fifth embodiment of the present invention.
Figure 20:
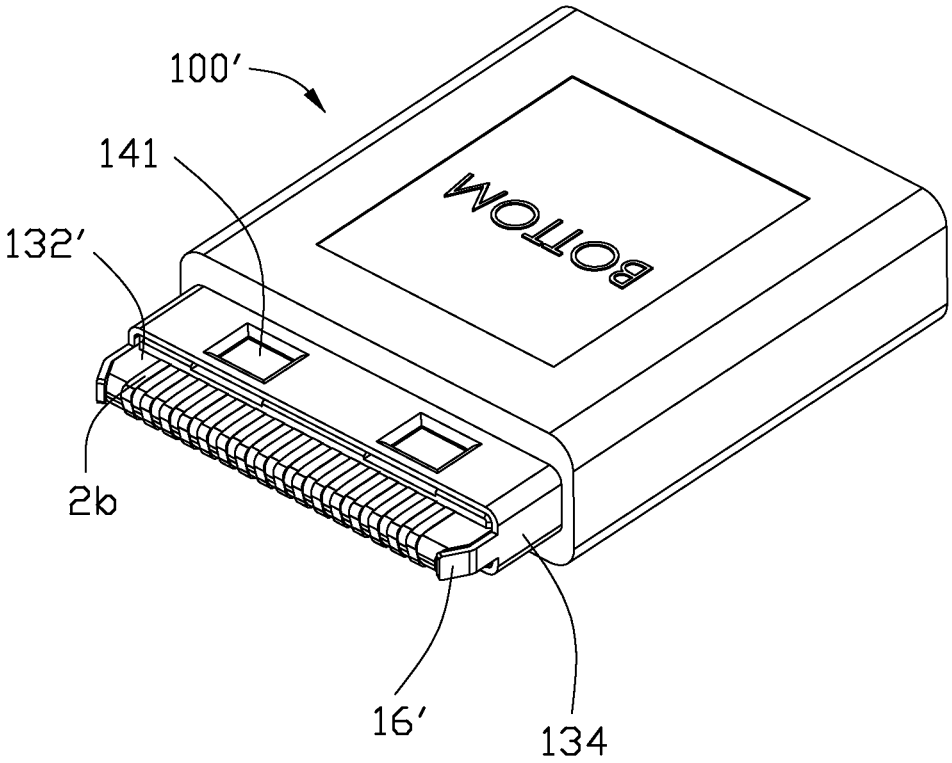
FIG. 20 is a front bottom perspective view of the plug connector shown in FIG. 19.

Referring to FIGS. 19-20 illustrating a fifth embodiment, the plug connector 100' connecting with a cable or a movable device, includes a connector tab 11' extending out of and longitudinally away from a body 12'. The connector tab 11' includes contact strips 2 positioned on opposing upper and lower surfaces 131', 132' of the plug connector. The connector tab 11' also includes two side surfaces 133, 134, that are substantially thinner than upper and lower surfaces 131', 132' and extend between the upper and lower surfaces 131', 132'. The plug connector 100' also includes a rear flat auxiliary edge 14' surrounding the connector tab 11' and extending from the upper and lower surfaces 131', 132' of the connector tab 11 to the body 12' that can be inserted within a metallic shell 7 of a receptacle connector 200' (shown in FIG. 4). The auxiliary edge 14' stiffens and reinforces the connector near its body 12' thus increase its strengthen in a side-load condition. In the embodiment shown in FIGS. 19 and 20, the connector tab 11' and the auxiliary edge 14' have essentially the same width along a width, X direction shown, but in other embodiments, an auxiliary edge of the connector can be wider than a connector tab.

Figure 21:
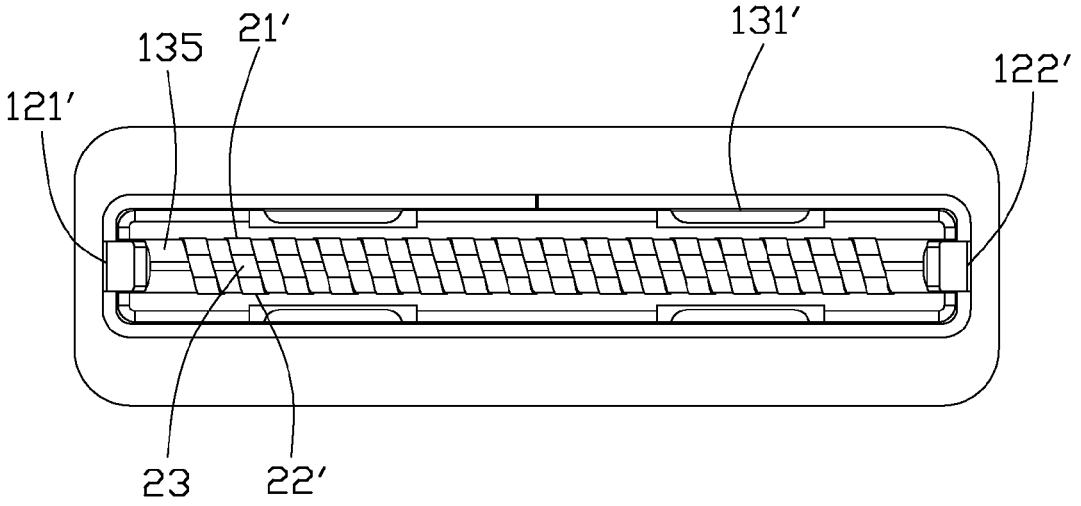
FIG. 21 is a front elevational view of the plug connector shown in FIG. 19.
Figure 22:
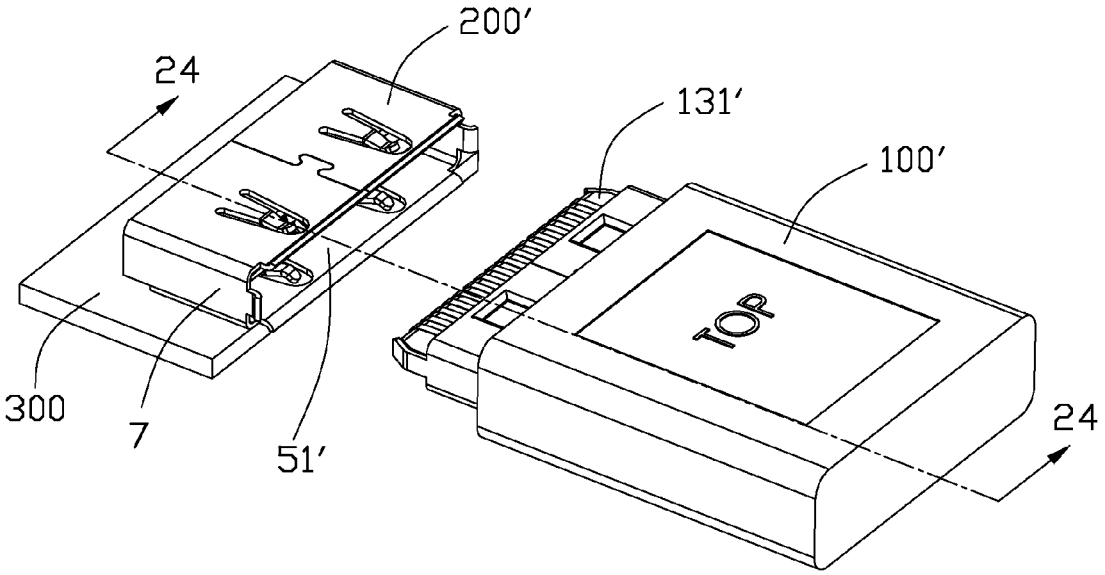
FIG. 22 is a perspective view of a receptacle connector of the fifth embodiment of this present invention, wherein the receptacle is ready for being inserted with the plug connector in a normal mating form.
Figure 23:
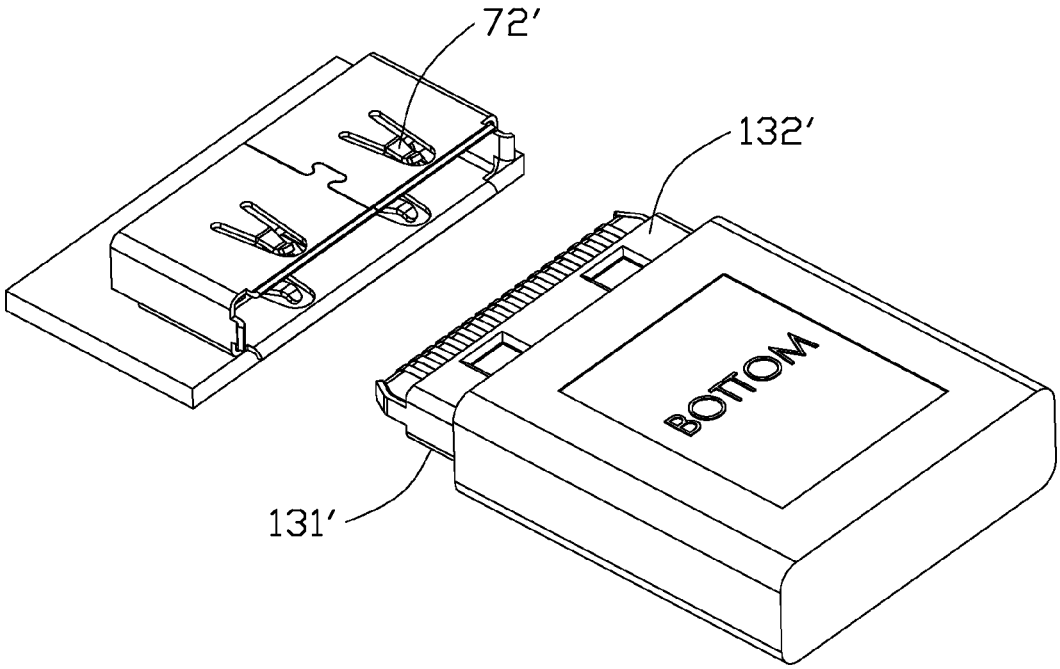
FIG. 23 is a perspective view of the receptacle connector which is ready for being inserted with the plug connector in a reversed mating form.

Combination with FIG. 21 to FIG. 23, while the plug connector 100' can be any type of connector and include any reasonable number of contacts, in one particular embodiment, the connector 100' includes sixteen contact strips 2 on each major surface to transmit USB protocol signals. The contact strips 2 are external contacts and the connector 100' does not include an exposed cavity in which particles and debris may collect. To improve robustness and reliability, the connector 100' may be fully sealed and include no moving parts.

The plug connector 100' is designed with a dual orientation design so that connector 100' can be inserted into the corresponding receptacle connector 200' in both a first orientation where upper surface 131' is facing up as shown in FIG. 22 or a second orientation where upper surface 131' is rotated 180 degrees and facing down as shown in FIG. 23. In such embodiments, the connector tab 11' is not polarized and designed with 180 degree symmetry outline, that means two halves of the connector tab 11' are same no matter the connector tab 11' are bisected along a centre horizontal plane or along a centre vertical plane. The plug connector 100' may include an identical number of contact strips 2 (i.e., contacting faces in fact) on each of the upper and lower surfaces 131', 132', but the contacts are asymmetric.

Each upper contact 2*a* on the upper surface 131' is electrically coupled to a corresponding lower contact 2*b* on the lower surface 132' that is positioned spaced from each other in a thickness, Z direction and offset from each other in the thickness direction of the connector tab 11'. In a preferred embodiment, the upper contact 2*a* and the corresponding lower contact 2*b* and made from a one-piece contact strip 21', that mean, each one-piece contact strip 2 includes a first contacting section 21' embedded in the upper surface 131' and a second contacting section 22' embedded in the lower surface 132', the first and second contacting sections each defines a contacting surface along an inserting, Y direction of the connector tab 11' perpendicular to the width direction. The first and second contacting sections 21', 22' connect with each other by a arc connection 23 embedded in a front surface 135 of the connector tab 11' (i.e., the arc connections 23 wrap around a front tip of the connector tab 11'). Seen from a front view of the connector 100' as shown in FIG. 21, the second contacting section 22' of each contact strip 2 is located offset from the first contacting section 21' in the thickness direction, not directly opposite from the first contacting section 21' in the thickness direction. The first and the second contacting sections 21', 22' are overlapped partially. The connector tab 11' defines a left front outermost edge 121' and a right outermost edge 122'. Please notes, the first contacting section 21' and the second contacting section 22' of each contact strip 2 spaces from the adjacent outermost edge with a different distance. The slant connecting portions 135 of the contacts are parallel to each other. In other embodiment, the upper contacts 2*a* and the lower contacts 2*b* can be made individual from each other and attached with each other to obtain an electrical connection.

The connector tab 11' can be made from a single piece of high strength non-conductive or insulated material with contact strips 2 being deposited directly on the plug. The contact strips 2 can be formed from stamped sheet metal that is placed in passageways defined on the upper and lower surfaces 131', 132'. The connector tab 11' can includes a lead-in feature 16' which is constructed with a slightly slantwise outer surface near the distal end of connector tab 11' at opposite side surfaces 133, 134 and a pair of latch recesses 141 at each major surface of the auxiliary edge 14'. The lead-in features 16' slope inward to guide the connector tab 11' within a mating cavity 51' defined at the receptacle connector 200', that make it easier to insert the plug connector 100' into the corresponding receptacle connector and/or only allow the plug connector 100' to be inserted in the correct orientation.

Figure 24:
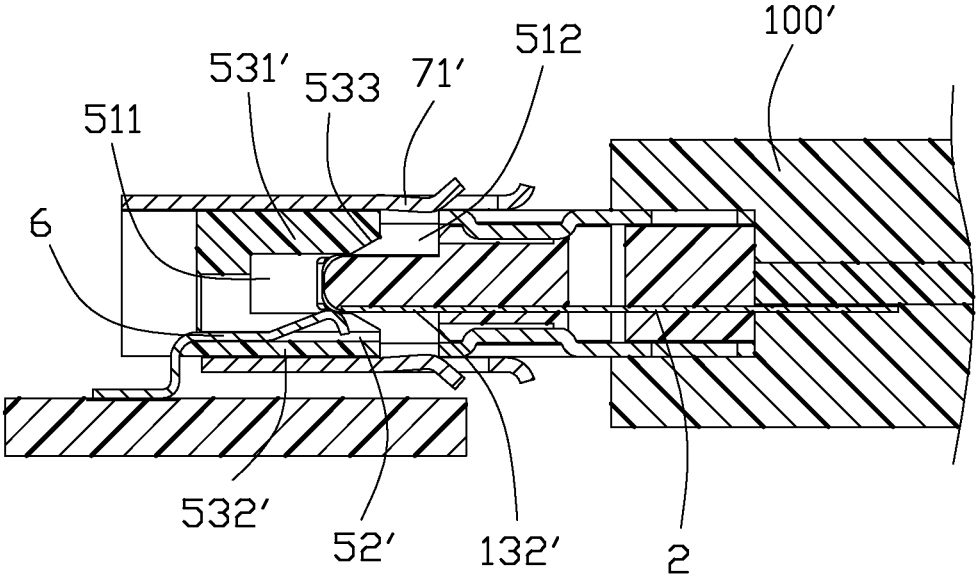
FIG. 24 is a cross-sectional view of said two connectors which are in a half mated statue taken along lines 24-24 in FIG. 22.

As shown in FIGS. 22 to 24, the receptacle connector 200' mounted on a printed circuit board 300 is designed to mate with the plug connector 100'. The receptacle connector 200' has the mating cavity 51' into which conductive contacts 6 extend. The conductive contacts 6 are wiping contacts that mate with contact strips 2 in plug connector 100'. Each of the conductive contacts 6 is positioned within respective individual passageways 52'. As shown in FIG. 24, when the plug connector 100' is inserted within mating cavity 51', the lower surface 132' of the plug connector 100' forces the flexure contacts 6 to spring back within their respective passageways 52'. Hence, when the two connectors 100' and 200' are mated, the bias of conductive contacts 6 causes them to press against contact strips 2, causing conductive contacts 6 to at least partially retract into the passageways 52', and ensures a solid electrical connection between the contacts of the two connectors when mated. Because each individual contact on one side of the receptacle connector 200' is electrically coupled to a corresponding contact on the opposing side of the plug connector, the receptacle connector 200' can be designed to include a single set of conductive contacts 6 on one side of the mating cavity 51' instead of having contacts formed on both top and bottom interior surfaces within the mating cavity 51'. This in turn allows receptacle connector 200' to have a reduced height compared to a similar receptacle connector with separate sets of contacts on opposing interior surfaces.

The mating cavity 51' can includes a rear sub-cavity 511 and a front cavity 512. The rear sub-cavity 511 is defined between two insulative boards 521,522 snugly surrounded with the metallic shell 7 and the front sub-cavity 512 is defined directly between two major walls 71 of the metallic shell 7 which extend forwards beyond the insulative boards 531', 532' in the inserted direction. The rear sub-cavity 511 is inserted with the connector tab 11' and the front sub-cavity 512 is inserted with the auxiliary edge 14' of the plug connector 100'. During insertion of the plug connector 100' into the receptacle connector 200', the connector tab 11' is easy to be lead into the mating cavity 51' since the connector tab 11' is thin in the thickness direction, the lead-in feature 16' is adapted for alignment in the width direction. Further more, the lead-in feature 16' assist to do a second step alignment during the connector tab 11' is guided into the rear sub-cavity 511 between the upper and lower insulative boards. The insulative boards define guiding chamfers 533 to help alignment of the connector tab 11' in the thickness direction. Inward-slant latch arms 72' defined on the metallic shell 7 lock into the locking recesses 141 on the auxiliary edge 14' to get a fitly engagement of the two connectors.

Figure 25:
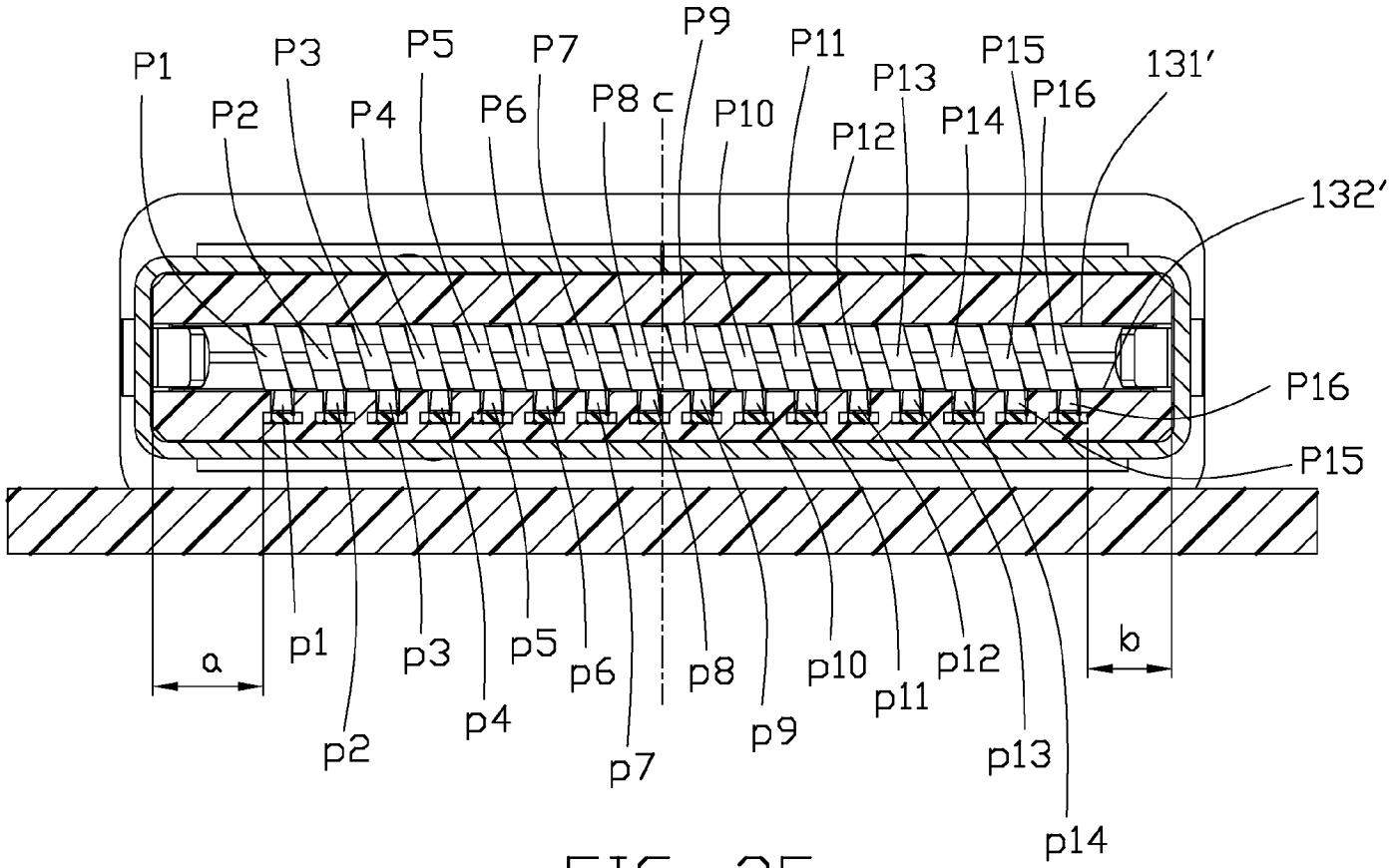
FIG. 25 is a schematic cross-sectional view of said two mated connectors in a normal mating form.
Figure 26:
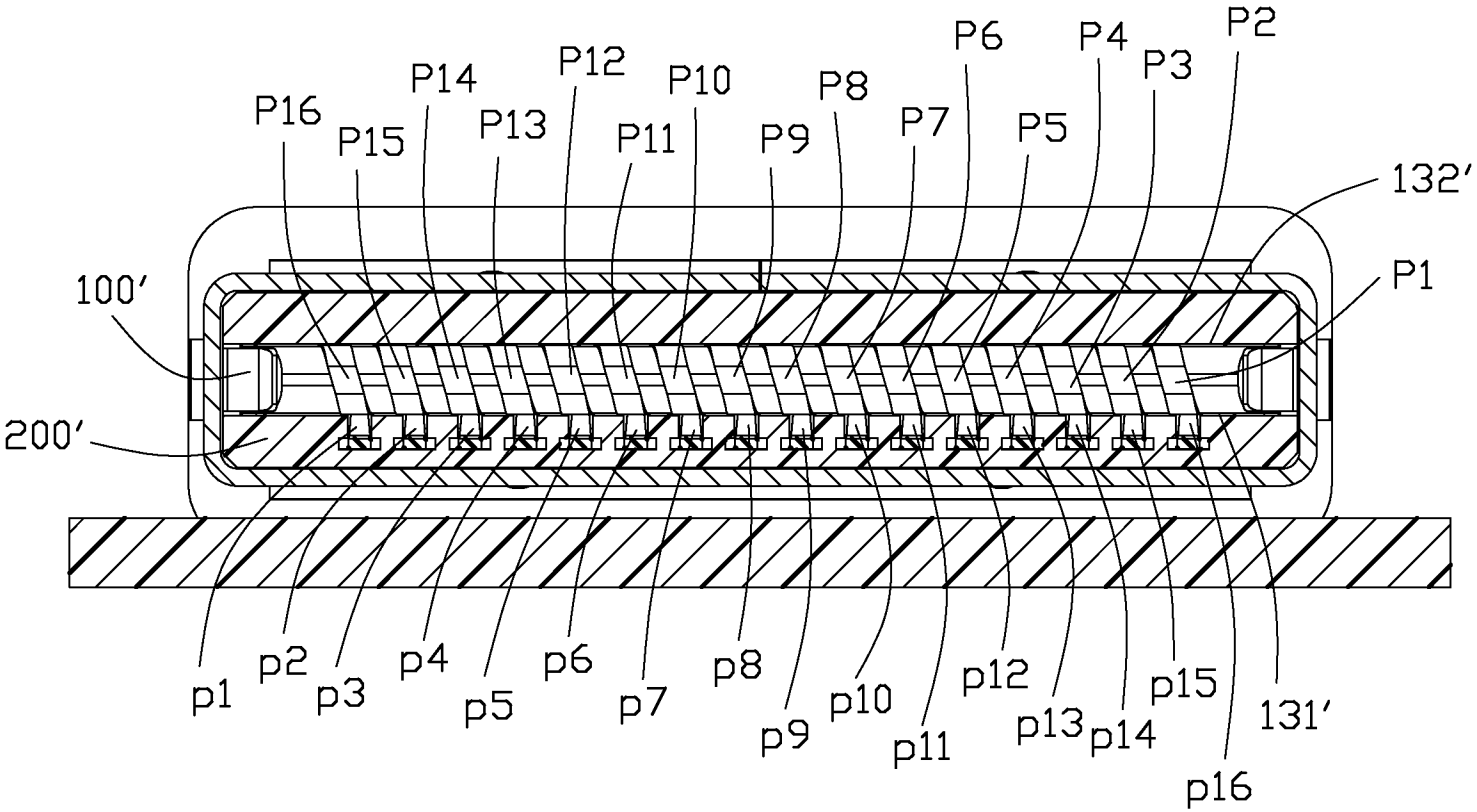
FIG. 26 is a schematic cross-sectional view of said two mated connectors in a reversed mating form.

FIGS. 25 and 26 showing the receptacle connector 200' is inserted with a normal mating of the plug connector 100' wherein the upper surface 131' faces up and a reverse mating of the plug connector wherein the upper surface 131' rotes 180 degrees and face down, respectively. For convenience of description, the contacts 2, 6 of the two connectors are labeled the numerals P1 to P16/p1-p16 from left to and right margins of the drawing sheet, and the connector tab 11' defines a centre vertical plane illustrated in lines C. The contacts at the left side of the centre vertical plane C and corresponding contacts at the right side of the centre vertical plane C are identical or complementary, coupled to be a pair, i.e., each pair of contacts transmit same signals or configured as a differential signal pair, thus, when the connector rotates 180 degree, the contacts still transmit suitable signals. As an example P8 contact corresponding p8 of the receptacle connector and if the connector was flipped over 180 degrees, P8 of the plug connector would contact p9 of the receptacle connector. Similarly, as another example, if the connector was flipped over 180 degrees, P9 of the plug connector 100' would contact p8. As an example, the table shown in FIG. 27 defines a pin-assignment of the contacts. Therefore, the plug connector 100' and the receptacle realize a flippable engagement since the receptacle connector needs no switches to detect the insertion of the plug connector as a result each pair of contacts are identical or complementary. The connector tab 11' and mating cavity 51' have a 180 degree symmetrical outline so that the mating cavity 51' can receive the connector tab in two orientations. The upper contacts 2*a* (i.e., first contacting sections 21') and the lower contacts 2*b* (i.e., second contacting sections 22') are asymmetric, the row of the conductive contacts 6 is located asymmetric with respective to one side of the mating cavity 51' which shift one side of the mating cavity 51' (i.e., with different distance (a, b) as shown in FIG. 7). The distance subtracting (b) from (a) equals a shifting distance between the second contacting sections 22' from the first contacting section 21'. The distance (a) equals (a) distance between the second contacting portion 22' and the left outermost edge 121' of the connector tab 11' and the distance (b) equals a distance between the first contacting section 21' and the left outermost edge 121' of the connector tab 11'.

Figure 28:
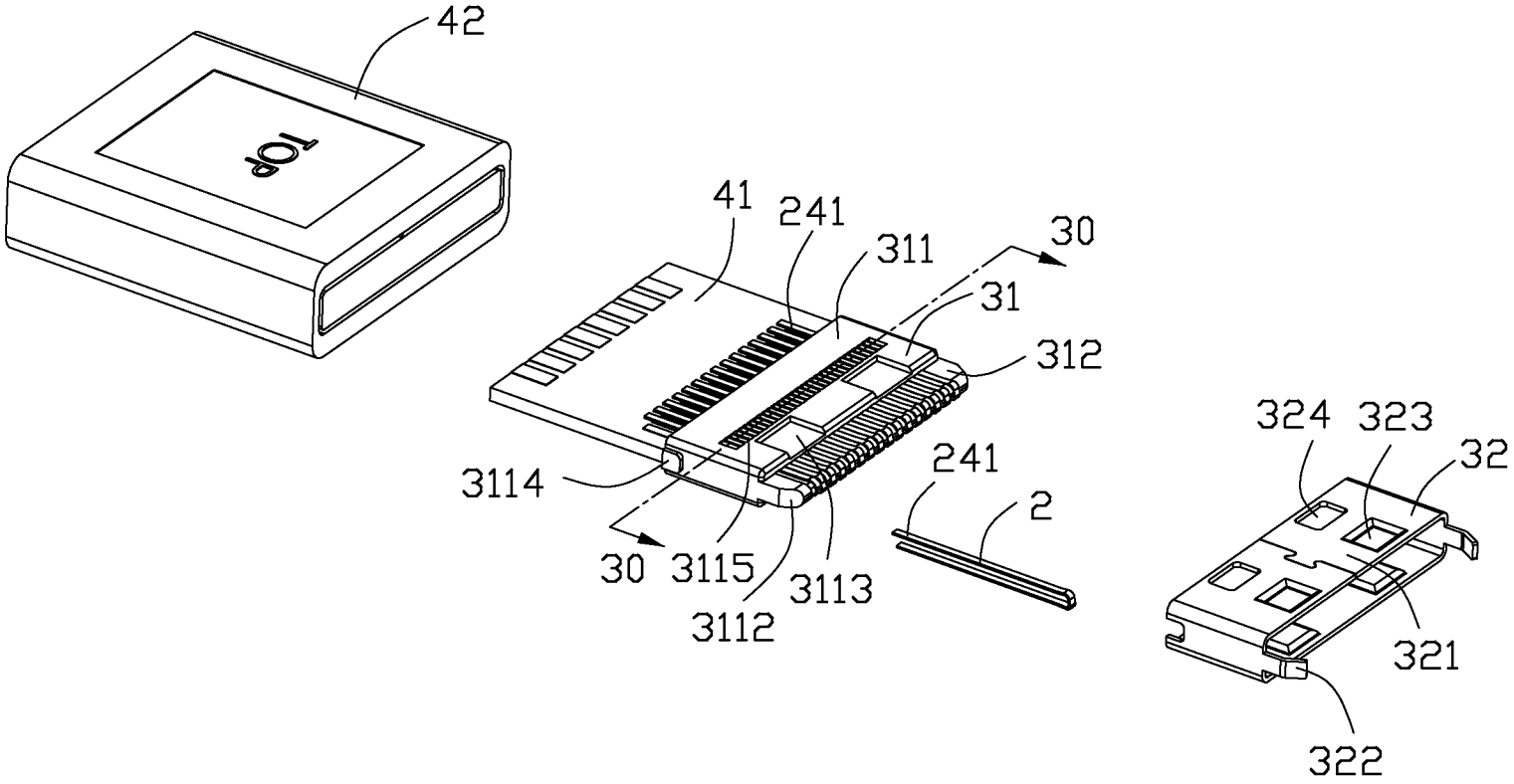
FIG. 28 is an exploded perspective view of the plug connector.
Figure 29:
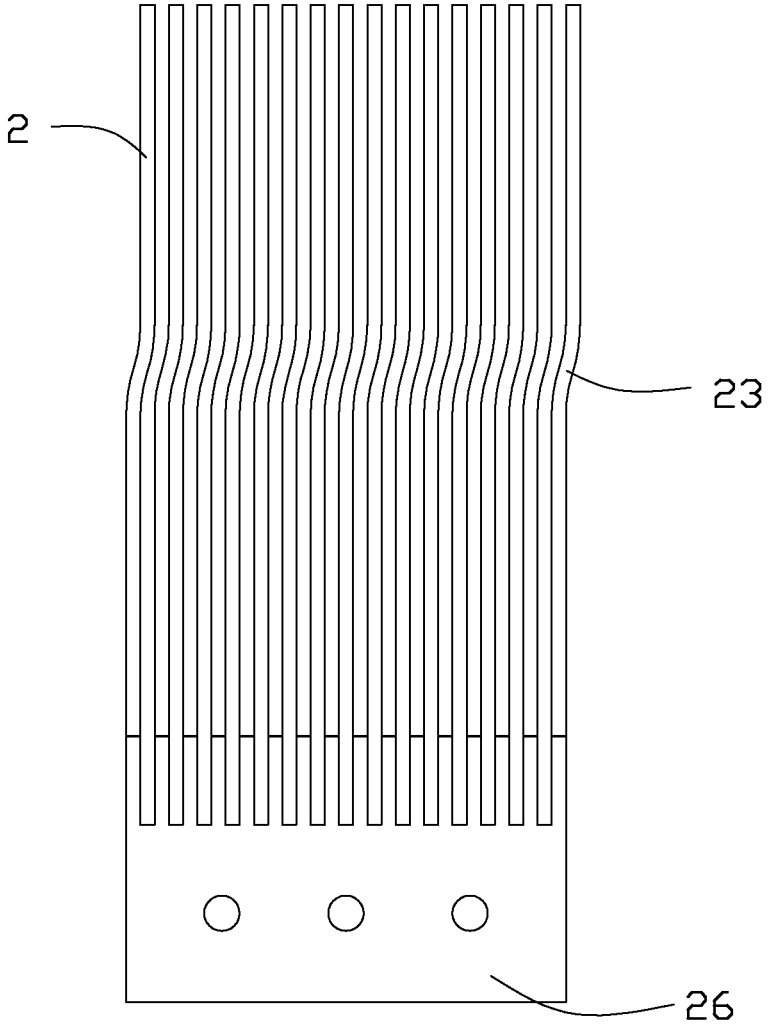
FIG. 29 is a schematic view of the contact strip.
Figure 30:
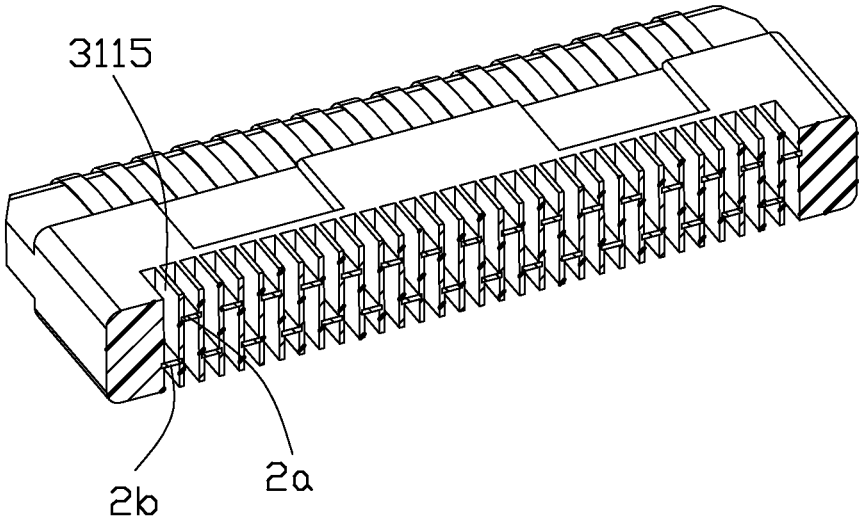
FIG. 30 is a cross-sectional view of the insulative seat of the plug connector taken along lines 30-30 in FIG. 28.

FIG. 28 shows an exploded perspective view of the plug connector 100'. The plug connector 100' includes a front connector body, a circuit paddle 41 and a cover 42. The connector body includes an insulative seat 31 and a metallic shell 32. The insulative seat 31 defines a rear base 311 and a front mating tongue 312 integrally from the rear base than the front tongue. The contact strips 2 are embedded in the in the insulative seat 31, the first and second contact sections expose to the surfaces of the front tongue 312. The rear portions 241 of the contacts go across the rear base 311 until the rear portions of the contacts extend from a rear face of the rear base. A plurality of holes 3115 through opposite major surface of the rear base is left. The connector body is formed by inserted mold process, wherein as shown in FIG. 29, the formed contact strips 2 are positioned in mold die by positioning tools (not shown) and then insulative material are inserted in the mold dies. The positioning tools are taken away after the connector body is cooled, and the holes are left. As shown in FIG. 29, the plurality of contact strips 2 is carried to a strip 26 in a slanted contact array. The contacts 2*a*, 2*b* are transverse to the holes as shown in FIG. 30, which is facility to spare of the cool.

The rear base 311 defines two notches 3113 at each major surfaces thereof and a locking boss 3114 at each side surface thereof, the notches run through a front face of the rear base. The mating tongue 312 defines two chambers 3112 at front side ends thereof. The metallic shell 32 includes a rectangular frame 321 snugly cover on the rear base 311 of the insulating seat 31 and a pair of guiding finger 322 extending from front edge of the side walls thereof. The guiding fingers 322 snugly attached on the side surfaces of the front tongue 312. The metallic shell 32 defines sealed recesses 323 corresponding to the notches 3113 on the rear base, which is punched downwards from the metallic shell 32. After the circuit paddle 41 is camped between and connecting with the two distal ends of the contacts, an insulative protecting cover 42 is injected to a rear end of the connector body. The metallic shell defines two holes 324 on the rear edge thereof, into which the insulative cover 42 is injected. Therefore, the most front portion of the connector body extending from the insulative cover 42 is defined as the connector tab 11 and the rear portion of the connector body and the insulating cover is defined as the body 12 as shown in FIG. 19.

Figure 31:
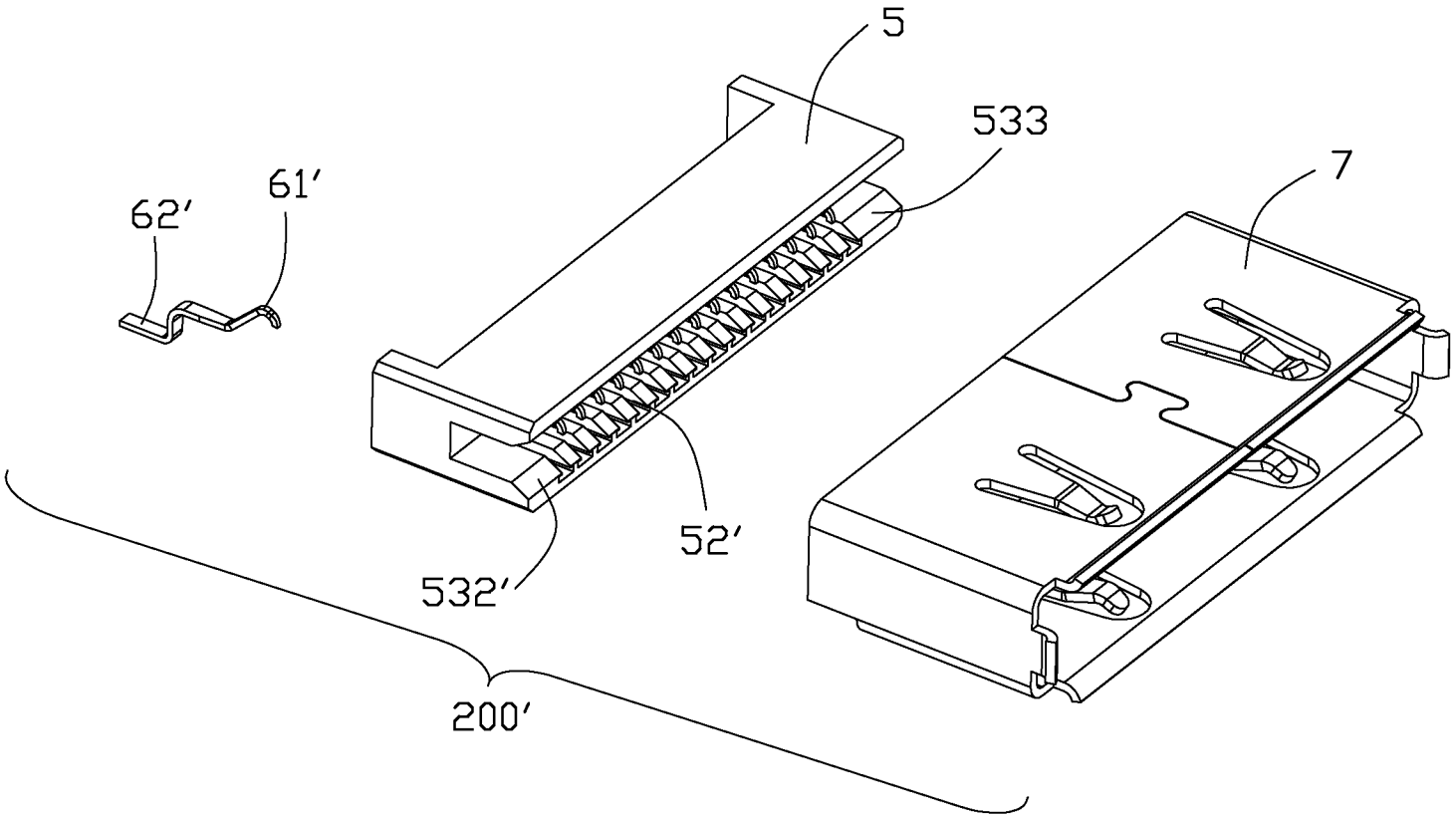
FIG. 31 is a front and side exploded perspective view of the receptacle connector in FIG. 22.
Figure 32:
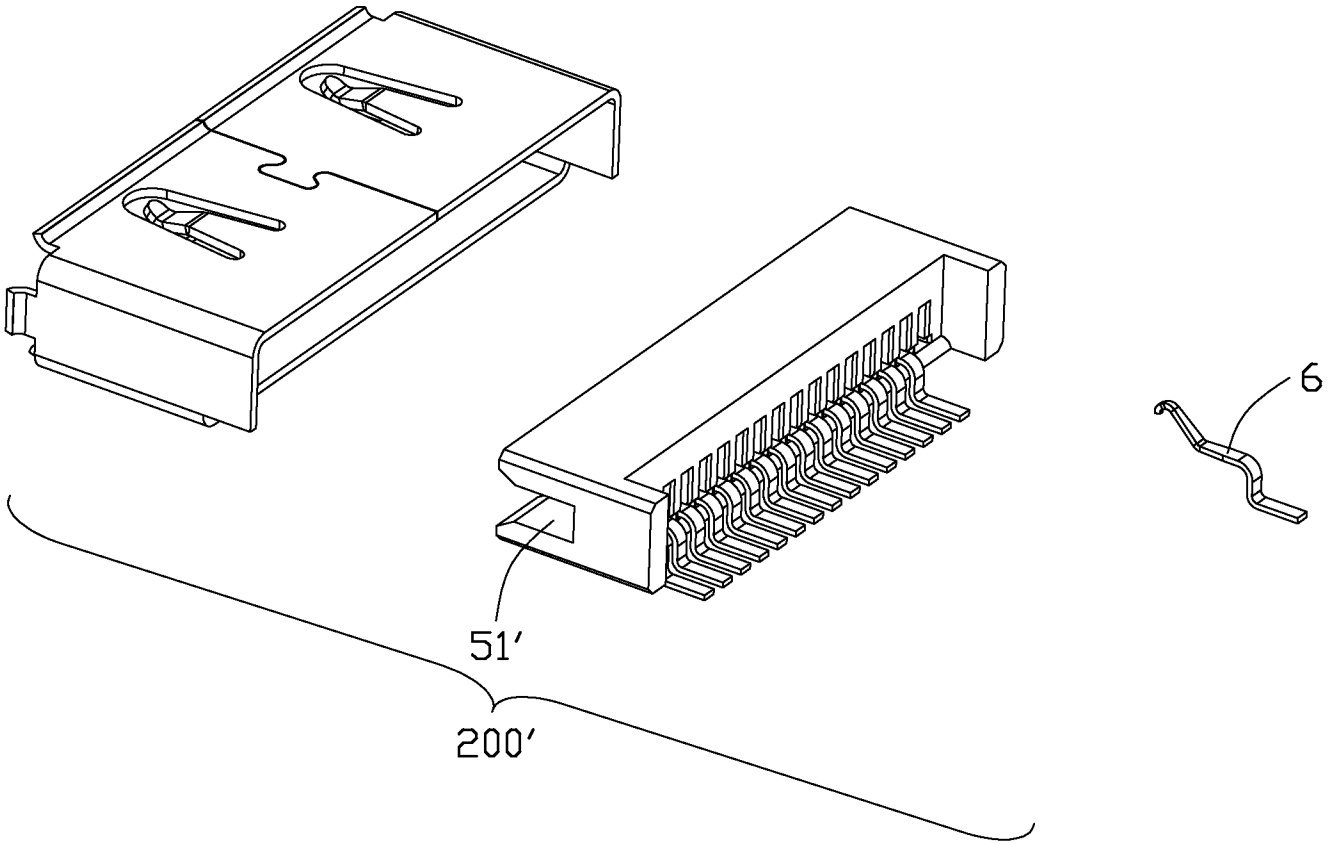
FIG. 32 is a rear and side exploded perspective view of the receptacle connector in FIG. 22.

FIGS. 31 and 32 shows an exploded perspective view of the receptacle connector 200' of one embodiment. The receptacle connector 200' comprises an insulative seat 5 and the metallic shell 7 surrounding the insulative housing. The lower insulative board 532' defines a row of passageways 52' and the conductive contacts 6 includes spring contacting portion 61' extending to the mating cavity 51' and soldering portion 62 extending a front face of the insulating seat. The upper and lower insulative boards 531', 532' define the chambers 533 for guiding the connector tab 11 of the plug connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing with a base and a mating tongue extending forwardly in a front-to-rear direction from the base, the mating tongue defining a first surface and a second surface opposite to each other;

a plurality of contact strips disposed around said first surface and said second surface of the mating tongue of the insulative housing;

each contact strip formed from stamped metal sheet and comprising a first contacting section exposed upon the first surface and arranged along a transverse direction perpendicular to the front-to-rear direction, and a second contacting section exposed upon the second surface and arranged along the transverse direction;

wherein the first and second contacting sections of each contact strip extend along the front-to-rear direction; wherein the electrical connector includes a metallic shell surrounding the insulative housing to define a mating cavity with the mating tongue extending in the mating cavity, and the first and second surfaces are commonly facing the mating cavity in an opposite manner; wherein the metallic shell defines a rigid tab bending into the mating cavity and extending in a plane perpendicular to the mating tongue for preventing mismating; wherein each contact strip defines an arc connection connecting the first contacting section with the second contacting section at a front end thereof; wherein the contact strip defines a mounting section extending out of the base of the insulative housing, a first connecting section construed between the mounting section and the first contacting section and a second connecting section extending from a rear end of the second connecting section opposite to the arc connection, the first and second connecting sections are mechanically connected with each other.

2. The electrical connector as claimed in claim 1, wherein the mating tongue and the first and the second contacting sections have a 180 degree symmetrical, double orientation design.

3. The electrical connector as claimed in claim 1, wherein the first and second connecting sections are arced toward each other until the two connecting sections are mechanically connected with each.

4. The electrical connector as claimed in claim 3, wherein the first contacting section at least partially overlaps with the second contacting section in a vertical direction perpendicular to both the front-to-rear direction and the transverse direction.

5. The electrical connector as claimed in claim 1, wherein both the first and second contacting sections rearwardly extend into the base of the insulative housing.

6. The electrical connector as claimed in claim 1, wherein said mating tongue defines a center line extending along the front-to-rear direction, and said tab is aligned with the center line in a vertical direction perpendicular to both said front-to-rear direction and said transverse direction.

7. The electrical connector as claimed in claim 6, wherein said center line is located in a vertical plane intersected with the mating tongue in a perpendicular manner.

8. An electrical connector, designed with a dual orientation design to be operatively coupled to a corresponding mating connector in either of two orientations, comprising:

an insulative housing with a base and a mating portion extending forwardly from the base in a front-to-rear direction, the mating portion defining a first surface and a second surface opposite to each other;

a plurality of contact strips disposed around the first and second surfaces of the mating portion of the insulative housing;

each contact strip formed from stamped metal sheet and comprising a first contacting section exposed upon the first surface and extending along the front-to-rear direction, a second contacting section exposed upon the second surface and extending along the front-to-rear direction, and a mounting section extending out of the base;

wherein each contact strip defines a first connecting section extending rearwardly into the base from the first contacting section to connect the first contacting section with the mounting section, and a second connecting section extending rearwardly into the base from the second contacting section, the first connecting section and the second connecting section are mechanically connecting with each other; wherein the contact strips are arranged in a transverse direction while characteristically symmetrically arranged with regard to a center line of the mating portion along said front-to-rear direction for performing the dual orientation design.

9. The electrical connector as claimed in claim 8, wherein the first and second contacting sections both are stiff and provide a gap therebetween.

10. The electrical connector as claimed in claim 9, wherein each contact strip defines an arc connection connecting the first contacting section with the second contacting section at a front end thereof.

11. The electrical connector as claimed in claim 10, wherein the mating portion is a mating tongue defining the first surface and the second surface opposite to each other.

12. The electrical connector as claimed in claim 11, wherein the first connecting section and the first contacting section are located on a same level, the first connecting section keeps linear and the second connecting section curves in a larger arc to mechanically touch with the first connecting section.

13. The electrical connector as claimed in claim 9, wherein the mating potion defines a mating cavity between two opposite insulative boards on which the first and second surfaces located, the first and second contacting sections are respectively located upon the opposite surfaces of the boards and facing to the mating cavity.

14. An electrical connector assembly comprising:

a receptacle connector including:

an insulative housing defining a mating tongue having opposite first and second mating surfaces thereon in a vertical direction, each of said first and second mating surfaces defined by a front-to-back direction and a transverse direction perpendicular to not only each other but also said vertical direction;

a plurality of first contacting sections disposed upon the first mating surface and spaced from each other along said transverse direction while each of said first contacting sections extending along the front-to-back direction;

a plurality of second contacting sections disposed upon the second mating surface and spaced from each other along said transverse direction while each of said second contacting sections extending along the front-to-back direction;

wherein the first contacting sections are characteristically symmetrically arranged, in the transverse direction, with regard to a center line of the mating tongue which extending along the front-to-back direction; and the second contacting sections are characteristically symmetrically arranged, in the transversely direction, with regard to said center line; wherein a symmetrical arrangement of both said first contacting sections and said second contacting sections allow dual-orientation mating of the electrical connector with a complementary plug connector;

the improvement being characterized with a metallic shield enclosing said insulative housing to form a mating cavity in which the mating tongue forwardly extends along the front-to-back direction; wherein said first and second mating surfaces are commonly facing the mating cavity in an opposite manner; wherein the metallic shield defines a rigid tab bending into the mating cavity and extending in a plane defined by the front-to-back direction and the vertical direction to be perpendicular to the mating tongue for preventing mis-mating by a wrong connector which is dimensioned similar to the complementary plug connector; wherein said complementary plug connector is connected to a cable and includes a metallic shell on a front mating port, and said metallic shell includes a pair of slots which are located around a center region thereof and opposite to each other in the vertical direction to compliantly receive the tab in dual orientations.

* * * * *